US006835085B2

(12) United States Patent
Sone et al.

(10) Patent No.: US 6,835,085 B2
(45) Date of Patent: Dec. 28, 2004

(54) CONNECTOR INCLUDING PLUG FIXING MEMBER AND ELECTRONIC APPARATUS HAVING THE CONNECTOR INCLUDING PLUG FIXING MEMBER

(75) Inventors: Motoki Sone, Nara (JP); Kazuhito Nagura, Kashihara (JP); Nobuyuki Ohe, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/309,012

(22) Filed: Dec. 4, 2002

(65) Prior Publication Data

US 2003/0109164 A1 Jun. 12, 2003

(30) Foreign Application Priority Data

Dec. 6, 2001 (JP) ..... 2001-373104
Nov. 21, 2002 (JP) ..... 2002-338508

(51) Int. Cl.[7] ..... H01R 13/627
(52) U.S. Cl. ..... 439/352; 439/346; 439/953
(58) Field of Search ..... 439/352, 347, 439/346, 266, 953

(56) References Cited

U.S. PATENT DOCUMENTS 2,520,739 A 8/1950 Shaw
3,493,917 A * 2/1970 Glowacz
3,569,903 A * 3/1971 Brishka
3,680,033 A * 7/1972 Kawai
4,275,946 A 6/1981 Manina et al.
4,420,216 A 12/1983 Motoyama et al.
5,248,168 A * 9/1993 Chichester et al. ..... 285/49
5,542,015 A * 7/1996 Hultermans ..... 385/60
6,343,814 B1 * 2/2002 Bucher et al.
6,447,170 B1 * 9/2002 Takahashi ..... 439/352

FOREIGN PATENT DOCUMENTS

JP 3041482 7/1997
JP 2000-14317 5/2000
WO WO 96/04696 2/1996

* cited by examiner

*Primary Examiner*—Neil Abrams
(74) *Attorney, Agent, or Firm*—Birch, Stewart, Kolasch & Birch, LLP

(57) ABSTRACT

The connector of the present invention is capable of insertion and removal of a plug having an unmoving section and a moving section that is movable with respect to the unmoving section. The connector includes a plug fixing member for fixing the unmoving section by movement of the moving section and the unmoving section in a plug insertion direction along with insertion of the plug into the connector, and for releasing the unmoving section by shifting of the moving section with respect to the unmoving section in a plug removal direction. On this account, it is possible to fix and release the plug according to the movement of the moving section of the plug.

12 Claims, 25 Drawing Sheets

CONNECTOR INCLUDING PLUG FIXING MEMBER AND ELECTRONIC APPARATUS HAVING THE CONNECTOR INCLUDING PLUG FIXING MEMBER

This nonprovisional application claims priority under 35 U.S.C. § 119(a) on Patent Application No. 2001-37104 and 2002-338508 filed in Japan on Dec. 6, 2001 and Nov. 21, 2002, which is herein incorporated by reference.

FIELD OF THE INVENTION

The present invention relates to a connector capable of connection of a plug provided on an end of a cable such as an optical fiber cable or the like, and an electronic apparatus having the connector.

BACKGROUND OF THE INVENTION

Conventionally, an electronic apparatus generally has a jack (such as a mini jack) so as to be connected to the other electronic apparatus for carrying out sending and receiving of a signal. The connection between each electronic apparatus using a jack is realized by inserting a plug, provided on an end of a connection cable, into the respective jacks of the electronic apparatuses.

These jack and plug are disclosed in Japanese Registered Utility Model Publication No. 3041482 (Registered on Jul. 2, 1997), for example. FIG. 27 shows the structure of the jack and the plug. As shown in the figure, the plug 301 has a large diameter section 302 on its front end, and a small diameter section 303 (constriction section) below the large diameter section 302. Meanwhile, a jack 311 has a joining section 312, made of a spring leaf for example, for fixing the plug.

When the plug 301 is placed in the jack 311, the plug 301 is inserted into the jack 311 in a direction A. In the jack 311, the plug 301 comes in and pushes the joining section 312 so that the joining section 312 is shifted to a direction orthogonal to an insertion direction of the plug 301 by following the shape of the large diameter section 302 of the plug 301. Thereafter, when the large diameter section 302 passes over the joining section 312, the small diameter section 303 of the plug 301 fits in the joining section 312. The insertion of the plug 301 into the jack 311 is completed with this state.

Removal of the plug 301 from the jack 311 is performed with a reverse operation of the insertion operation. With the movement of the plug 301 to a removal direction (opposite direction of the direction A), the large diameter section 302 of the plug 301 directly affects on the joining section 312 of the jack 311. This removal is realized by exerting relatively small force on the plug 301. Conversely, when the plug 301 is pulled with force smaller than the necessary force for the removal, the plug 301 stays in the jack 311.

Note that, as shown in FIG. 28, the foregoing publication also discloses other type of jack (a jack 321) having an improved joining section 322; however, its basic structure and the operation for removing the plug 301 are the same as those of the jack 311.

The plug 301 and the jack 311 thus described have a simple structure and an affordable price, and also the plug 301 is easily inserted/removed into/from the jack 311. On the other hand, since the plug 301 is easily removed from the jack 311 with small force, sending/receiving of a signal between electronic apparatuses connected to each other with a cable is likely to cut off. Particularly, for a connection between stationary electric apparatuses, inadequate adaptation of the plug 301 and the jack 311 may cause removal of the plug 301 from the jack 311 due to vibration etc.

Meanwhile, in order to prevent the unwanted removal of the plug, a mechanical lock is used for a connection between the plug and the connector in the Ethernet®, or in Japanese Unexamined Patent Publication Tokukaihei 2000-147317 (published on May 26, 2000), for example.

In the teaching of the foregoing publication, as shown in FIG. 29, an optical fiber cable 333 has a plug 331 on an end, and the plug 331 includes a claw section 332 jutting out of the main body of the plug 331. The claw section 332 is joined to an engaging section 342 of the connector 341 when the plug 331 is placed in the connector 341. With this arrangement, it is possible to prevent the unwanted removal of the plug 331 from the connector 341. Note that, the removal of the plug 331 from the connector 341 is performed by pulling the plug 331 in a removal direction while pressing the claw section 332 to the main body of the plug 331.

However, the plug 331 shown in FIG. 29 includes the claw section 332 jutting out of its main body in addition to the main body for being inserted into the connector 341, and therefore the structure is difficult to be downsized. Further, the connector 341 requires the engaging section 342 to correspond to the claw section 332, which requires the electronic apparatus including the connector 341 to have some space for providing the engaging section 342.

Further, the mechanical lock, used for the Ethernet®, for example, has a structure requiring a user to confirm the rotation direction of the lock system provided on the plug, thereby causing some inconvenience.

Meanwhile, in recent years, a plug having a moving section on a portion inserted into a connector has been proposed as a solution for the foregoing problems. A connector corresponds to this type of plug can have a structure such that the moving section affects on the mechanical lock system. However, there has not yet been a proposal for such a connector.

SUMMARY OF THE INVENTION

The present invention is made in view of the foregoing conventional problems, and an object is to provide a connector capable of connection of a plug having a moving section on a portion to be inserted into the connector, and an electronic apparatus having the connector.

In order to solve the foregoing problems, the connector of the present invention is capable of insertion and removal of a plug having a male engaging section and a moving section that is movable with respect to the male engaging section. The connector includes a plug fixing member for fixing the male engaging section when the moving section is shifted in a plug insertion direction with the insertion of the plug, and for releasing the male engaging section thus fixed when the moving section is shifted in a plug removal direction.

With the foregoing arrangement, the plug fixing member fixes the male engaging section when the moving section is shifted in the plug insertion direction with the insertion of the plug. Meanwhile, the plug fixing member releases the male engaging section thus fixed with the shifting of the moving section in the plug removal direction. Accordingly, the plug can be fixed and released by the movement of the moving section of the plug.

Further, an electronic apparatus of the present invention is provided with the described connector.

Additional objects, features, and strengths of the present invention will be made clear by the description below.

Further, the advantages of the present invention will be evident from the following explanation in reference to the drawings.

BRIEF DESCRIPTION OF THE DRAWINGS

FIG. 4(*b*) is a vertical cross-sectional view schematically showing a state where the plug is further inserted and a pressed section of the connector is pressed by the moving section of the plug. FIG. 4(*c*) is a vertical cross-sectional view schematically showing a state where the insertion of the plug into the connector is completed.

FIG. 13(*b*) is a vertical cross-sectional view schematically showing a state where the insertion of the plug into the connector is completed.

FIG. 16(*b*) is a vertical cross-sectional view schematically showing a state where the insertion of the plug into the connector is completed. FIG. 16(*c*) is a vertical cross-sectional view schematically showing an initial state of removal of the plug shown in FIG. 16(*b*), from the connector.

FIG. 19(*b*) is a vertical cross-sectional view schematically showing a state where the insertion of the plug into the connector is completed. FIG. 19(*c*) is a vertical cross-sectional view schematically showing an initial state of removal of the plug shown in FIG. 19(*b*), from the connector.

FIG. 24(*b*) is a vertical cross-sectional view schematically showing a state where the insertion of the plug into the connector is completed. FIG. 24(*c*) is a vertical cross-sectional view schematically showing an operation of the connector in the case where the plug shown in FIG. 24(*b*) is removed from the connector without moving the moving section of the plug.

DESCRIPTION OF THE EMBODIMENTS

[Embodiment 1]

The following will explain one embodiment of the present invention with reference to FIGS. 1 through 7.

Figure 2:
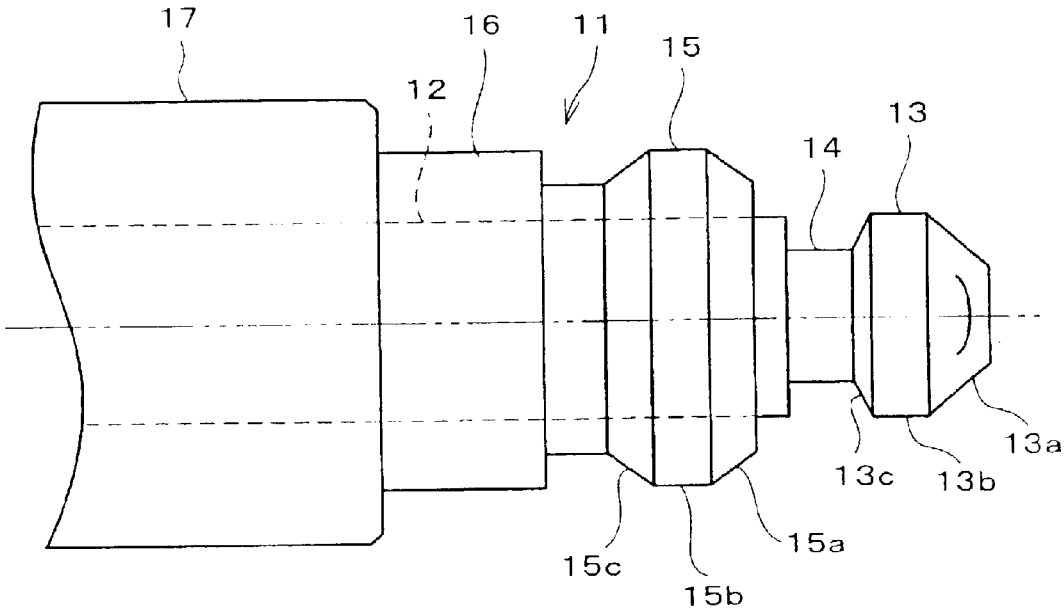
FIG. 2 is a front view showing a plug corresponding to the connector shown in FIG. 1, in a state where a moving section is on a forward position.
Figure 3:
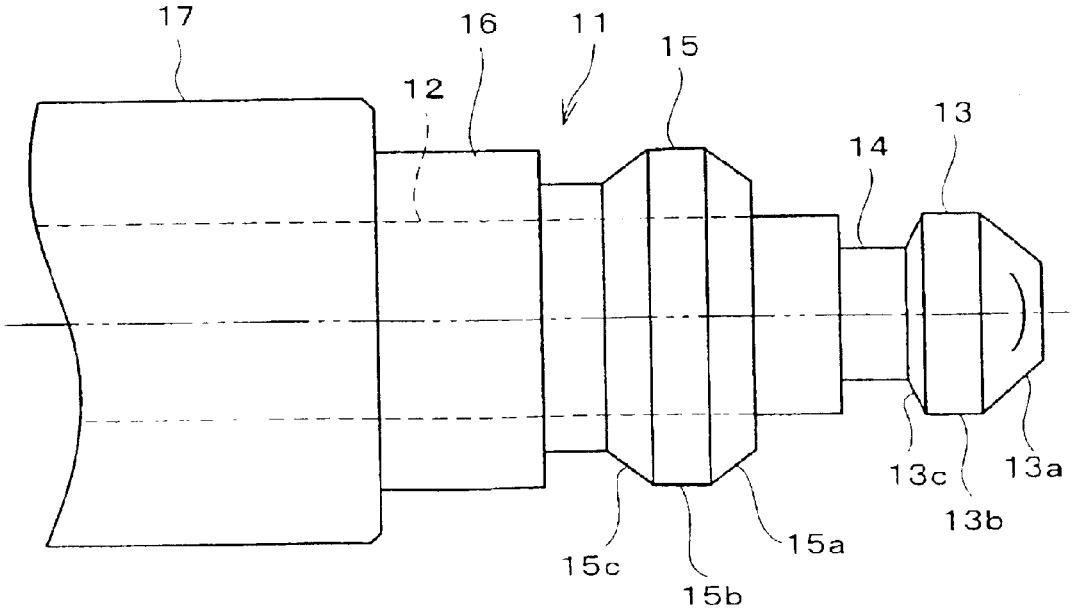
FIG. 3 is a front view showing the plug corresponding to the connector shown in FIG. 1 in a state where the moving section is on a backward position.

A plug corresponding to a connector of the present embodiment has an arrangement shown in FIGS. 2 and 3. As shown in the figure, the plug 11 has an axis section 12 in its center. The axis section 12 therein has optical fiber, for example. In the front end of the axis section 12, a male engaging section 13 is provided. The male engaging section (unmoving section) 13 has a front sloped surface 13*a*, a uniform diameter surface 13*b*, and a back sloped surface (sloped surface) 13*c* in this order from the front end side to the back end side.

In the axis section 12, a small diameter section (constriction section) 14 is formed behind the male engaging section 13, whose diameter is smaller than that of the male engaging section 13. The periphery of the small diameter section 14 is uniform in diameter.

In the plug 11, a moving section 15 is formed behind the small diameter section 14. The moving section 15 has a front sloped surface 15*a*, a uniform diameter surface 15*b*, and a back sloped surface 15*c* in this order from the front end side to the back end side. The uniform diameter surface 15*b* is larger in diameter than the small diameter section 14 or the uniform diameter surface 13*b* of the male engaging section 13. The moving section 15 is joined to the periphery of the axis section 12 while being movable backwards and forwards. Accordingly, the moving section 15 is movable backwards and forwards with respect to the male engaging section 13 and the small diameter section 14 in an axis direction of the plug 11, i.e., in an insertion/removal direction into/from a connector 21 (described later).

Further, the moving section 15 is connected to a handle section 17 via an intermediate section 16. Therefore, the moving section 15 is moved together with the handle section 17. The intermediate section 16 operates as a guide section for guiding the plug 11 to be inserted into the connector 21. Further, the handle section 17 operates as a holding section for a user to insert/ remove the plug 11.

Further, the moving section 15 is forced to be back in a front end direction of the plug 11 by an elastic member. FIG. 2 shows a state where the moving section 15 is in a most forward position due to the force by the elastic member. FIG. 3 shows a state where the moving section is in a most backward position by being moved with the handle section 17 which is pulled by a user.

Figure 1:
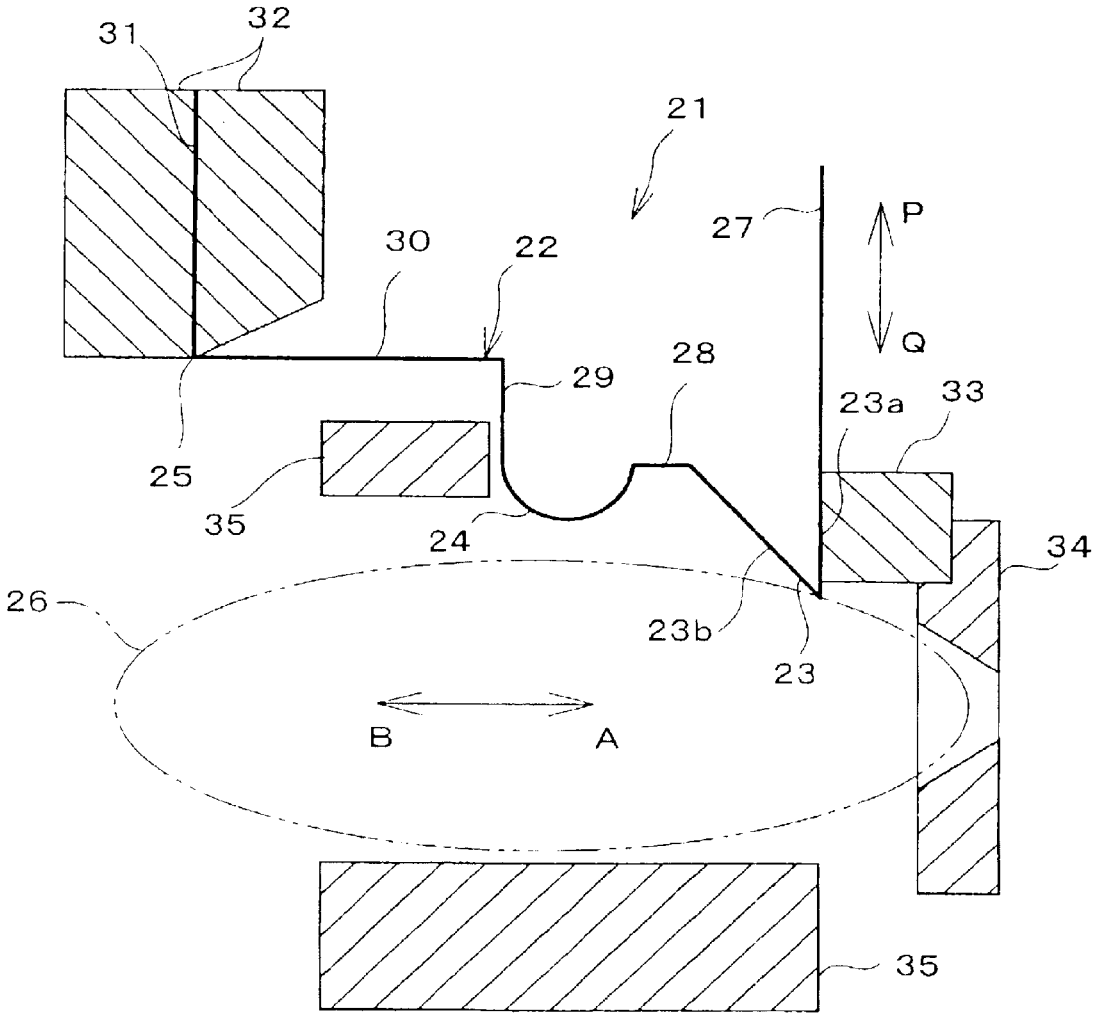
FIG. 1 is a vertical cross-sectional view schematically showing an arrangement of a connector according to one embodiment of the present invention.

The connector 21 corresponding to the plug 11 therein has a mechanical lock system as shown in FIG. 1. The mechanical lock system has a plug fixing member (plug fixing means) 22 made of a spring leaf, for example. The plug fixing member 22 has a female engaging section 23, a pressed section 24, and a supporting section (predetermined supporting section) 25 in this order in an insertion direction of the plug, i.e., from the front end side (direction A) to the back end side (direction B). The female engaging section 23 (engaging section), the pressed section 24, and the supporting section 25 are provided on one side in the periphery of a plug area 26 where the plug 11 is inserted and placed in the connector 21. Further, the female engaging section 23 and the pressed section 24 are extended in a direction toward the plug area 26, and a front end of the female engaging section 23 is closer to the plug area 26 than that of the pressed section 24.

The female engaging section 23 is formed by folding the plug fixing member 22 into a substantially V-shape. The female engaging section 23 has a first surface 23*a* in a side of direction A, which is the insertion direction of the plug, and a second surface 23*b* in a side of direction B, which is the removal direction of the plug. The first surface 23*a* comes in contact with the back sloped surface 13*c* of the male engaging section 13 of the plug 11 at least when the plug 11 is removed from the connector 21. The second surface 23*b* comes in contact with the front sloped surface 13*a* of the male engaging section 13 of the plug 11 when the plug 11 is inserted into the connector 21. Note that, the second surface 23*b* is not necessarily required to be in contact with the front sloped surface 13*a*.

The angle of the first surface 23*a* with respect to the direction A when the plug is completely inserted into the connector 21 is larger than the angle of the second surface 23*b* with respect to the direction B before the plug is inserted into the connector 21. On this account, the female engaging section 23 easily allows the plug 11 be inserted in the plug area 26 while appropriately preventing the plug 11 from being removed from the plug area 26 when the moving section 15 of the plug 11 is not moved.

An insertion direction end extension section 27 is a portion of the plug fixing member 22, from the female engaging section 23 to the end of the plug insertion direction, which is extended to be away from the plug area 26 (toward the direction P) in a direction (P-Q direction) orthogonal to the insertion direction (direction A) of the plug.

The pressed section 24 is formed to be a curved shape (for example, a half circular arc shape) extended in a direction of the plug area 26, i.e., in the direction Q. Further, a depression section 28 receded toward the direction P is formed between the female engaging section 23 and the pressed section 24.

The supporting section 25 is connected to the pressed section 24 via intermediate extension sections 29 and 30. The intermediate extension section 30 is extended from the supporting section 25 in the direction A, and the intermediate extension section 29 is extended in the direction Q from the A direction end of the intermediate extension section 30. The end of the removal side of the plug 11 of the plug fixing member 22 is folded in the direction P at a substantially right angle at the supporting point 25 to form a removal direction end extension section 31.

The removal direction end extension section 31 is carried from both sides by carrying members 32. With this arrangement, in the plug fixing member 22, a portion extended from the supporting section 25 in the direction A is movable in the P-Q direction due to elastic deformation in the supporting section 25 and the intermediate extension section 30, and also due to a stress (hereinafter referred to as a rotation stress) to be back from the elastic deformation. As described, the rotation stress is a force in the plug fixing member 22 to be back from the elastic deformation, and affects as a rotation force about the supporting section 25. The various connector examples described below equally have this operation due to the rotation stress.

Further, the connector 21 has a guide member 33 on a side of the direction A of the insertion direction end extension section 27 or the female engaging section 23 for guiding the female engaging section 23 to be moved in the P-Q direction. Further, a front end positioning member 34 is provided on the end of the plug area 26 in the direction A for preventing the plug 11 from being moved further than the plug area 26 in the direction A. Furthermore, a guide member 35 is provided around the plug area 26 for guiding the plug 11 to be inserted/removed into/from the plug area 26.

In the foregoing arrangement, to insert the plug 11 into the connector 21, a user holds the handle section 17 of the plug 11 and inserts the plug 11 with respect to the connector 21 in the direction A. With this insertion operation, firstly, the guide member 35 of the connector 21 guides the moving section 15 of the plug 11 to be moved forward, as shown in FIG. 4(*a*).

Secondly, the front sloped surface 13*a* of the male engaging section 13 of the plug 11 comes in contact with the second surface 23*b* of the female engaging section 23 of the connector 21, and also the front sloped surface 15*a* of the moving section 15 of the plug 11 comes in contact with the pressed section 24 of the connector 21. As a result, the female engaging section 23 and the pressed section 24 are pushed and shifted in the direction P. Here, this movement of the female engaging section 23 is guided by the guide member 33.

Note that, the foregoing operation is not limited to the arrangement where the female engaging section 23 and the pressed section 24 of the connector 21 are shifted together by being respectively pushed by the male engaging section 13 and the moving section 15; and it may be arranged such that the female engaging section 23 and the pressed section 24 are shifted with either operation by the male engaging section 13 or the moving section 15.

Figure 4A:
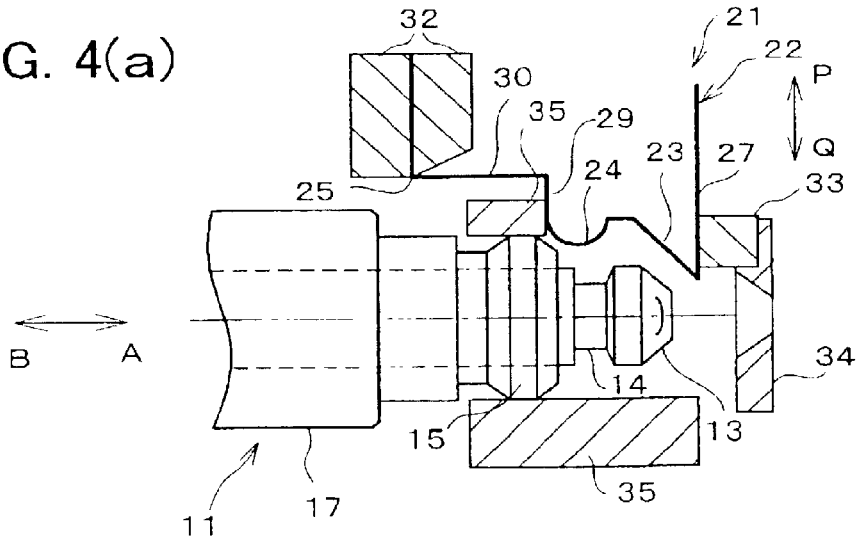
FIG. 4(*a*) is a vertical cross-sectional view schematically showing an initial state of insertion of a plug into the connector shown in FIG. 1.
Figure 4B:
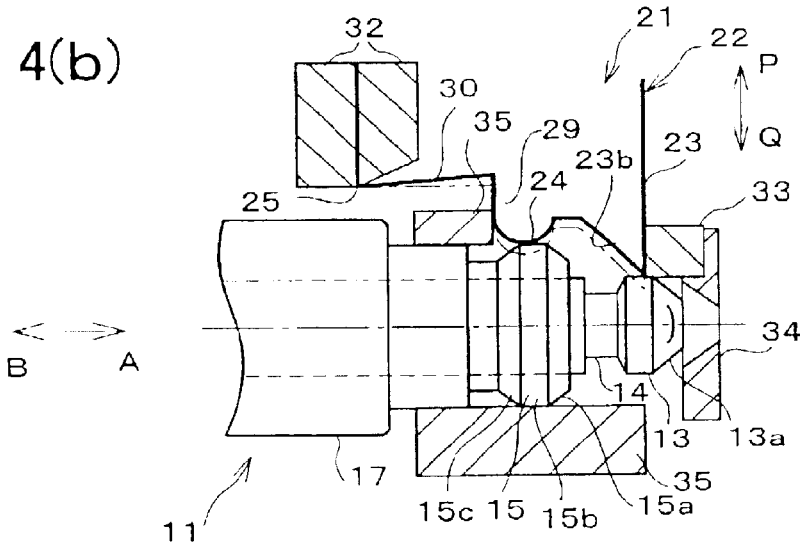
Figure 4C:
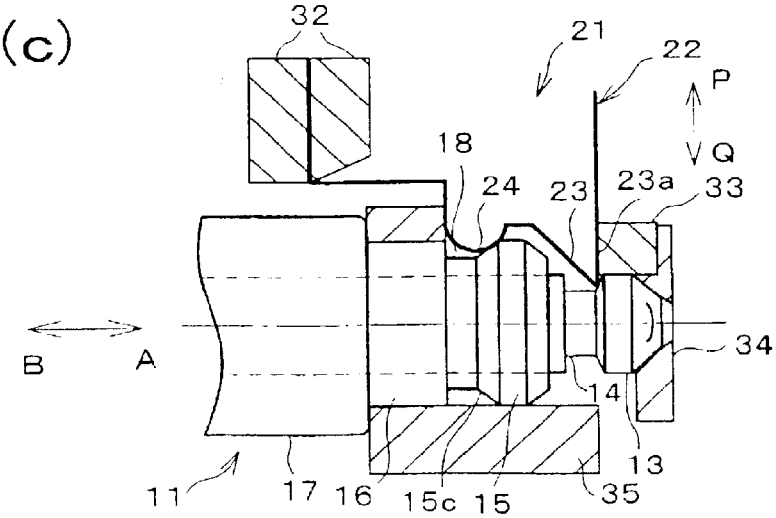

Next, as shown in FIG. 4(*b*), the pressed section 24 of the connector 21 comes on the uniform diameter surface 15*b* having the largest diameter of the moving section 15 of the plug 11. Here, the intermediate section 16 of the plug 11 is guided by the guide member 35.

Thereafter, as shown in FIG. 4(*c*), when the uniform diameter surface 15*b* of the moving section 15 of the plug 11 passes through the pressed section 24 of the connector 21, the pressed section 24 falls in the depression section 18 between the uniform diameter surface 15*b* of the moving section 15 and the intermediate section 16 due to the rotation stress about the supporting point 25. With this operation, the female engaging section 23 of the connector 21 is moved in the direction Q and gets in the small diameter section 14 so as to be engaged with the back end section, i.e., the back sloped surface 13*c* of the male engaging section 13 of the plug 11. Consequently, by thus engaging the male engaging section 13 with the female engaging section 23, the removal of the plug 11 from the connector 21 due to pulling force exerted on a connection cable where the plug 11 is provided can be prevented.

Further, in this state, the front end of the male engaging section 13 of the plug 11 comes in contact with the front end positioning member 34. Thus, the plug 11 is prevented from being moved further than the current position in the direction A.

Further, as described, The angle of the first surface 23*a* with respect to the direction A when the plug is completely inserted into the connector 21 is larger than the angle of the second surface 23*b* with respect to the direction B before the plug is inserted into the connector 21. Accordingly, the movement of the plug 11 in the direction B is appropriately prevented by the female engaging section 23. On this account, the easy removal of the plug 11 from the connector 21 due to pulling force exerted on a connection cable where the plug 11 is provided can be prevented.

Next, in order to remove the plug 11, which is in the insertion state into the connector 21 as shown in FIG. 4(*c*), from the connector 21, a user holds the handle section 17 of the plug 11 and pulls the plug 11 in the direction B.

With this operation, the moving section 15 of the plug 11 is moved in the direction B with the handle section 17 of the plug 11 so that the pressed section 24 of the connector 21 passes through the back sloped surface 15*c* of the moving section 15 and then comes on the uniform diameter surface 15*b*. As a result, as shown in FIG. 4(*b*), the pressed section 24 of the connector 21 is shifted in the direction P and the female engaging section 23 is moved in the direction P. Consequently, the female engaging section 23 is disengaged from the male engaging section 13 of the plug 11, which allows the plug 11 to be moved in the direction B, i.e., to be removed from the connector 21. Then, the plug 11 is removed from the connector 21 after the state shown in FIG. 4(*a*).

As thus described, the connector 21 of the present invention makes it possible to easily remove the plug 11 from the connector 21 by pulling the handle section 17 of the plug 11.

Note that, the connector 21 of the present embodiment may be arranged such that the plug 11 is removed from the insertion state into the connector 21 without shifting of the handle section 17 when a great force in the removing direction of the plug 11 is exerted on a connection cable where the plug 11 is provided.

This function can be realized by appropriately adjusting the angle of slope of the first surface 23*a* of the female engaging section 23 of the connector 21 in the insertion state, i.e., the angle of the first surface 23*a* with respect to the direction A. Otherwise, when the plug fixing member 22 is made of a spring leaf, the function can be realized by adjusting the strength of the spring or the strength of the material on a portion between the female engaging section 23 and the supporting section 25.

Figure 5:
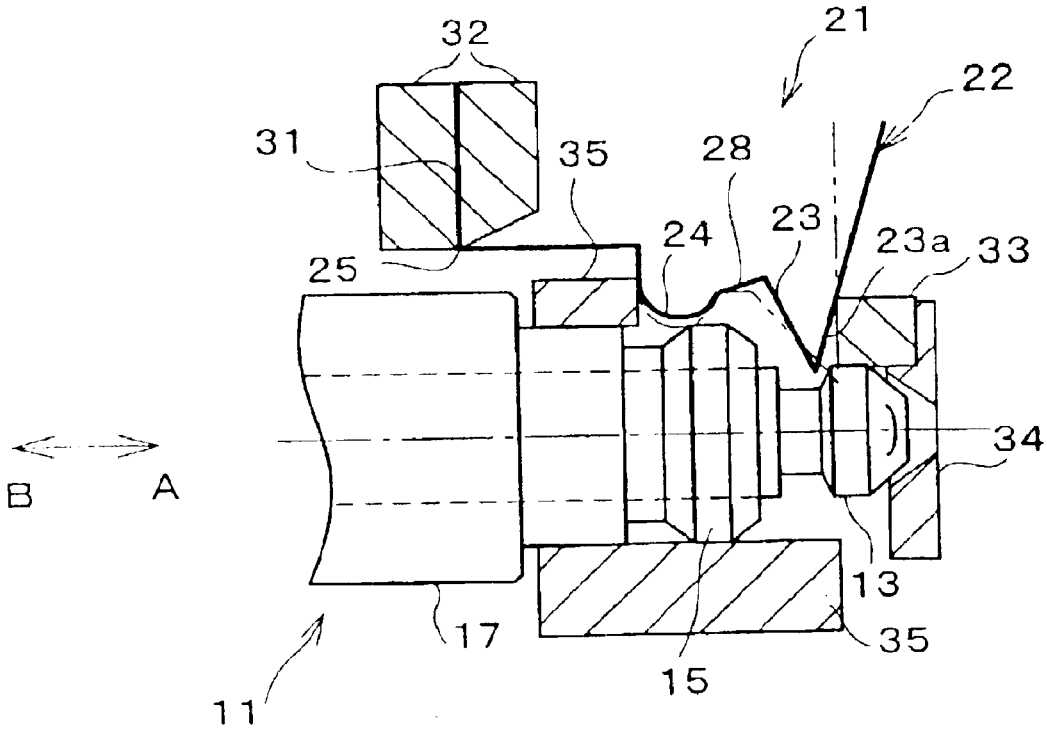
FIG. 5 is a vertical cross-sectional view schematically showing a state where the insertion of the plug into the connector shown in FIG. 1 is completed when a first surface of a female engaging section of the connector is changed in angle.

FIG. 5 shows the female engaging section 23 of the connector 21 whose first surface 23*a* is adjusted to an arbitrary angle. In this example, the angle of the first surface 23*a* with respect to the direction A when the plug is inserted is adjusted to be smaller than the case shown in FIG. 4(*c*) so as to reduce engagement force of the female engaging section 23 with the male engaging section 13. Namely, when the pulling force in the direction B is exerted on the plug 11 (the male engaging section 13), the male engaging section 13 is more easily removed from the engagement state with the female engaging section 23 by a small arcuation in a portion between the female engaging section 23 and the supporting section 25, for example, in the depression section 28.

With the foregoing arrangement, when a great force is exerted on the plug 11, such as a case where one's foot stumbles on the connection cable, it is possible to prevent breakage of the plug 11 and/or the connector 21, and also, to prevent falling and breakage of the electronic apparatus to which the connection cable is connected.

Figure 6:
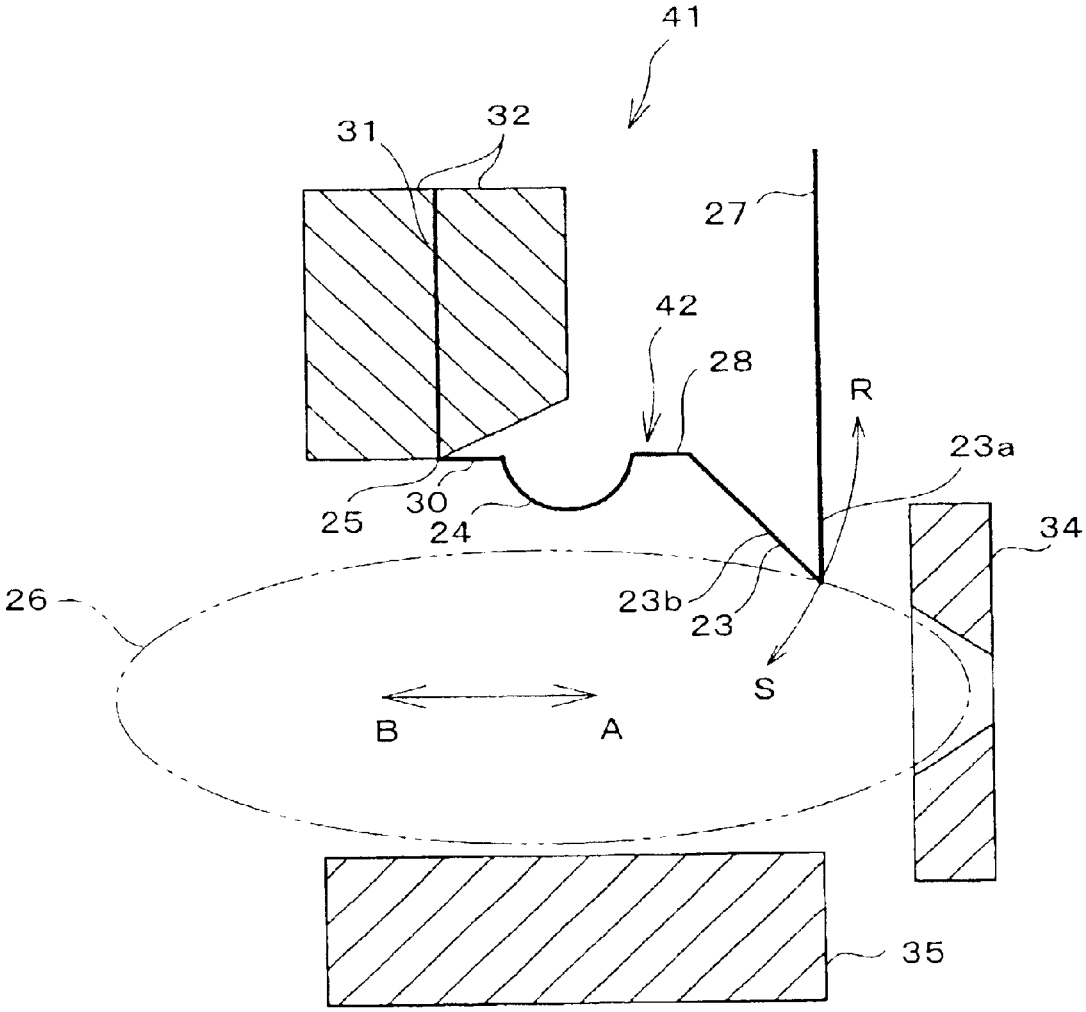
FIG. 6 is a vertical cross-sectional view schematically showing a variation of the connector shown in FIG. 1.

Further, the connector 41 of FIG. 6, having a similar arrangement of the connector 21, can be made from the connector 21. The connector 41 has a plug fixing member (plug fixing means) 42. The plug fixing member 42 does not include the intermediate extension section 29, and includes the intermediate extension section 30 shorter in length than that of the plug fixing member 22. Accordingly, in the plug fixing member 42, the length between the supporting section 25 and the front end of the female engaging section 23 is shorter than that of the plug fixing member 22. For this reason, the connector 41 can be made smaller than the connector 21.

In the connector 21, the guide member 33 guides the movement of the female engaging section 23, and therefore the track of the front end of the female engaging section 23 is a straight line extended in the P-Q direction. In contrast, in the connector 41, the length between the supporting section 25 and the female engaging section 23 is shorter than that of the plug fixing member 22 as thus described, and therefore the track of the front end of the female engaging section 23 is a circular arc extended substantially in the R-S direction. Note that, the relation between the first surface 23*a* and the second surface 23*b* of the female engaging section 23 is the same as that of the connector 21.

Figure 7:
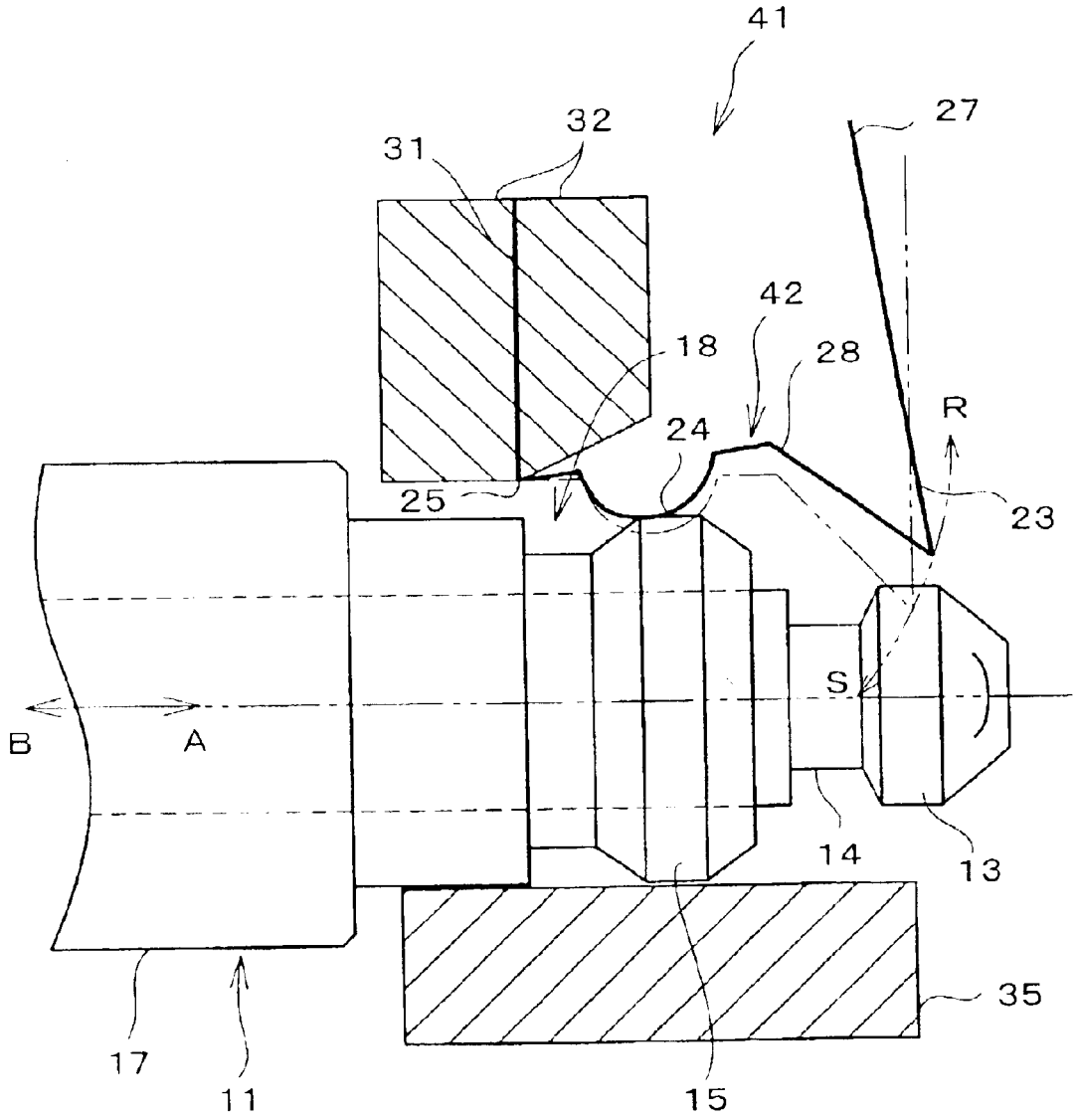
FIG. 7 is a vertical cross-sectional view schematically showing an operation of the connector shown in FIG. 6 when a plug is inserted therein.

When the plug 11 is inserted into the connector 41 having the foregoing arrangement, as shown in FIG. 7, the pressed section 24 of the connector 41 is pressed by the moving section 15 of the plug 11 with the insertion of the plug 11, and the female engaging section 23 is rotated in the direction R.

Thereafter, the moving section 15 of the plug 11 passes through the pressed section 24, and the pressed section 24 falls in the depression section 18 of the plug 11. With this operation, the female engaging section 23 is rotated in the direction S and gets in the small diameter section 14, then is engaged with the back end section of the male engaging section 13 of the plug 11. On this account, it is possible to prevent the removal of the plug 11 in the direction B when a pulling force is exerted on the connection cable.

When the plug 11 is removed from the connector 41, the handle section 17 is pulled to move the moving section 15 of the plug 11 in the direction B so that the pressed section 24 of the connector 41 comes on the uniform diameter surface 15*b* of the moving section 15. As a result, the pressed section 24 of the connector 41 is shifted, and the female engaging section 23 is moved in the direction R. Consequently, the female engaging section 23 is disengaged from the male engaging section 13 of the plug 11, which allows the plug 11 to be removed from the connector 41.

Note that, the connector 41 may also have the function for removing the plug 11 from the insertion state into the connector 41 without shifting of the handle section 17 when a great force in the removing direction of the plug 11 is exerted on a connection cable, by having the same arrangement as that of the connector 21.

Further, in the connector 21, the plug fixing member 22 is not necessary to be entirely made of an elastic body, as it requires at least one component of elastic body among the supporting section 25, the intermediate extension section 30, the intermediate extension section 29, and the pressed section 24. Similarly, in the connector 41, the plug fixing member 42 requires at least one component of elastic body among the supporting section 25, the intermediate extension section 30, and the pressed section 24.

Further, the connectors 21 and 41 are arranged such that the carrying members 32, the removal direction end extension section 31 and some other components are provided on the insertion entrance side of the plug 11 (the side of the direction B), and also no components are extended to the front end side of the plug 11 (the side of the direction A) further than the front end positioning member 34. Therefore, the connectors 21 and 41 are suitable for an electronic apparatus having components such as a light emitter, a photo receptor, a complicated circuit and/or the like on the front end side of the plug 11.

[Embodiment 2]

Figure 8:
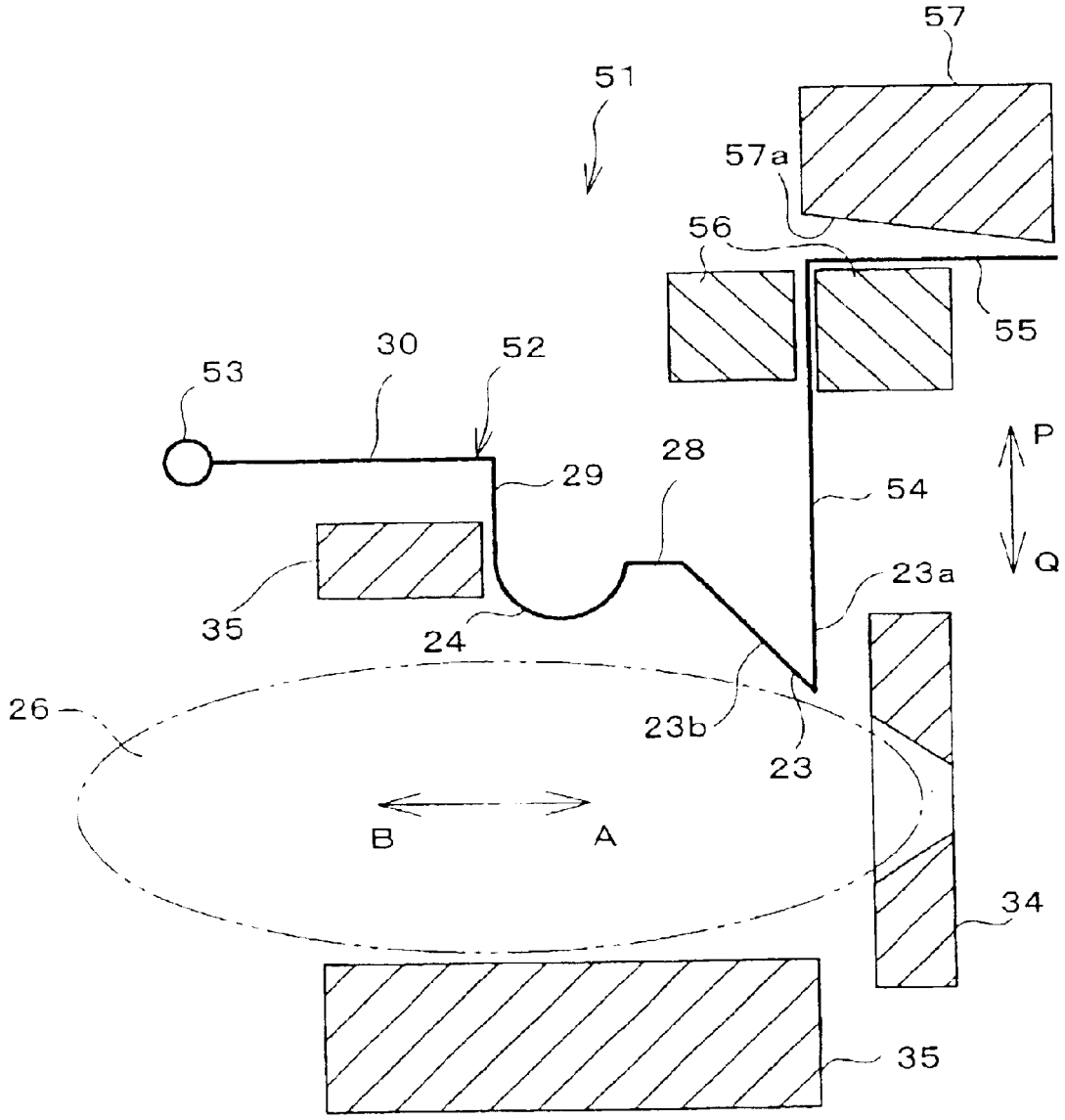
FIG. 8 is a vertical cross-sectional view schematically showing an arrangement of a connector according to another embodiment of the present invention.
Figure 9:
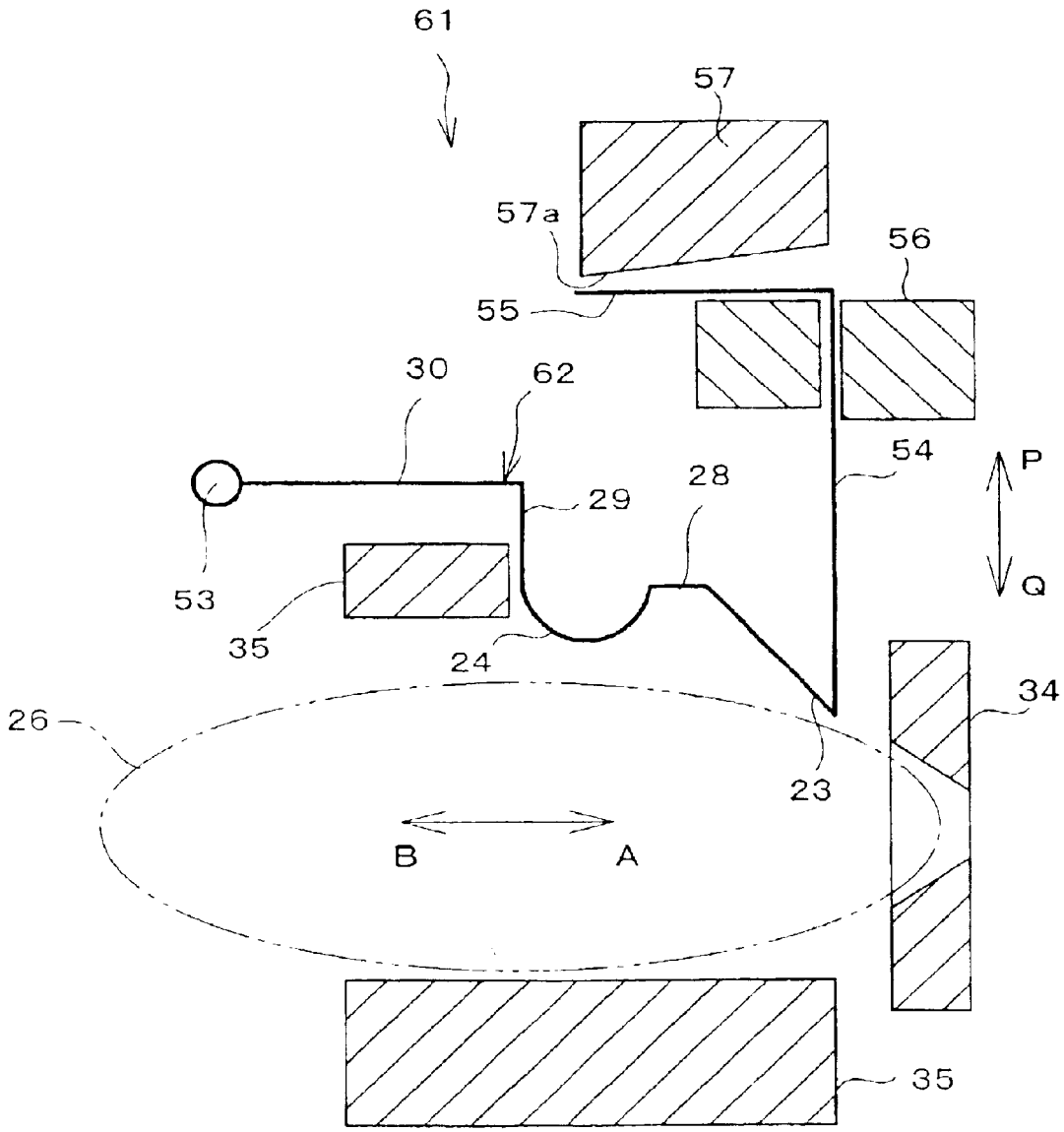
FIG. 9 is a vertical cross-sectional view schematically showing an arrangement of the connector shown in FIG. 1 when an insertion direction end extension section is folded to the opposite direction.
Figure 10:
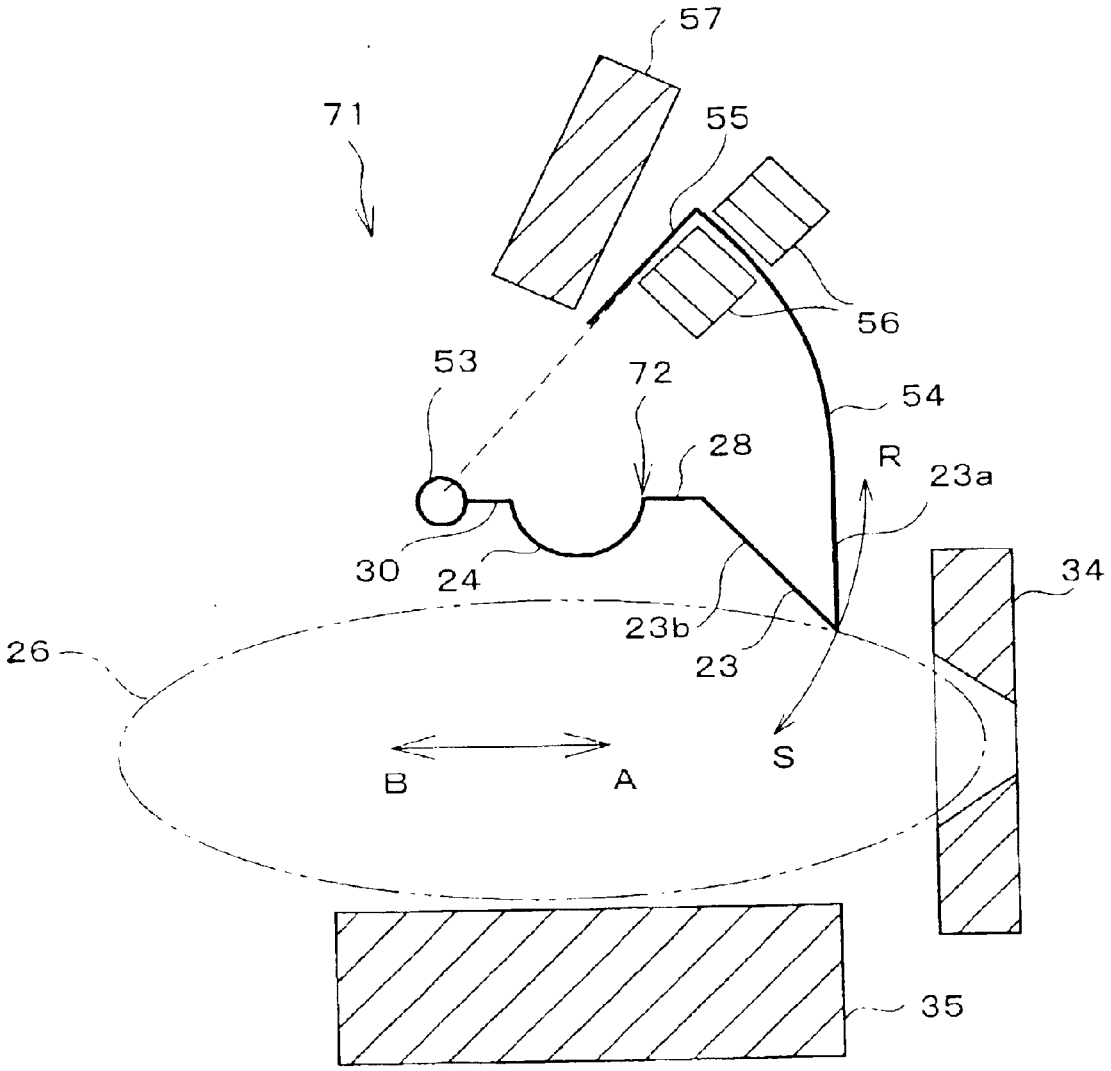
FIG. 10 is a vertical cross-sectional view schematically showing a variation of the connector shown in FIG. 1.

The following will explain another embodiment of the present invention with reference to FIGS. 8 through 10. For ease of explanation, materials having the equivalent functions as those shown in the drawings pertaining to Embodiment 1 above will be given the same reference symbols, and explanation thereof will be omitted here.

As shown in FIG. 8, the connector 51 of the present embodiment has a plug fixing member (plug fixing means) 52 made of a spring leaf, for example. The plug fixing member 52 has a female engaging section (engaging section) 23, a pressed section 24, and a supporting section (predetermined supporting section) 53 in this order in a removal direction of the plug, i.e., in the direction B. Further, the plug fixing member 52 has a depression section 28 between the female engaging section 23 and the pressed section 24, and has intermediate extension sections 29 and 30 between the pressed section 24 and the supporting section 53.

The female engaging section 23, the pressed section 24, and the supporting section 53 are provided on one side in the periphery of a plug area 26. Further, the female engaging section 23 and the pressed section 24 are extended in a direction toward the plug area 26, and the front end of the female engaging section 23 is closer to the plug area 26 than that of the pressed section 24.

The relation between the first surface 23*a* and the second surface 23*b* in the female engaging section 23 is the same as that of the described connector 21: the angle of the first surface 23*a* with respect to the direction A when the plug is completely inserted into the connector 51 is larger than the angle of the second surface 23*b* with respect to the direction B before the plug is inserted into the connector 51.

The supporting section 53 is provided on the end section in the direction B. The supporting section 53 supports the plug fixing member 52 to make it rotatable about the supporting section 53.

Further, the plug fixing member 52 has an insertion direction end extension section 54 provided from the female engaging section 23 to the end of the plug insertion direction in the direction P, and an insertion direction end extension section (extension section) 55 extended from the end of the P direction of the insertion direction end extension section 54 toward the direction A. The insertion direction end extension section 54 is moved in the P-Q direction by being guided by the guide members 56 provided both side of the insertion direction end extension section 54. The insertion direction end extension section 55 is arranged to be previously in contact with a sloped surface 57*a* of a catching member 57 with the front end, or it comes in contact with the sloped surface 57*a* from the front end, when the insertion direction end extension section 54 is shifted in the direction P. The sloped surface 57*a* has a slope to make the gap between the insertion direction end extension section 55 and the sloped surface 57*a* gradually widening from the contacting position with the end of the an insertion direction end extension section 55 toward the turning section to be the insertion direction end extension section 54. Note that, the catching member 57 does not necessarily require the sloped surface 57*a*, and may be provided with an angle of the sloped surface 57*a*.

With the foregoing arrangement, when a force in the direction P is exerted on the insertion direction end extension section 54 to be moved in the direction P, the insertion direction end extension section 55 follows the slope of the sloped surface 57*a* so that the angle formed by the insertion direction end extension section 55 with the insertion direction end extension section 54 becomes narrower. On the other hand, when the exerted force in the direction P is released, the angle formed by the insertion direction end extension section 55 with the insertion direction end extension section 54 becomes wider again to be back to the original angle due to elasticity (rotation stress) of the insertion direction end extension section 55, and the insertion direction end extension section 54 is moved in the direction Q.

In the foregoing arrangement, the operation of the pressed section 24 and the female engaging section 23 when the plug 11 is inserted into the connector 51, and the operation of the pressed section 24 and the female engaging section 23 when the plug 11 is removed from the connector 51 are the same as those of the described connector 21 shown in FIG. 1. However, it should be noted that the connector 51 of the present embodiment uses the elasticity of the insertion direction end extension section 55 as the force (rotation stress) for engaging the female engaging section 23 and the male engaging section (unmoving section) 13 of the plug 11, unlike the connector 21 which uses the elasticity of a portion between the pressed section 24 and the supporting section 25 as the engaging force.

Note that, as with the described connector 21, the connector 51 may also have the function for removing the plug 11 from the insertion state into the connector 51 without shifting of the handle section 17 when a great force in the removing direction of the plug 11 is exerted on a connection cable where the plug 11 is provided. More specifically, this function can be realized, for example, by appropriately adjusting the angle of slope of the first surface 23*a* of the female engaging section 23 of the connector 51 in the insertion state, i.e., the angle of the first surface 23*a* with respect to the direction A. Otherwise, when the plug fixing member 52 is made of a spring leaf, the function can be realized by adjusting the strength of the spring or the strength of the material on a portion between the female engaging section 23 and the supporting section 53.

Further, the connector 51 is arranged such that the insertion direction end extension section 55 of the plug fixing member 52 is extended in the direction A. However, the present embodiment may also adopt an arrangement shown in FIG. 9 in which the insertion direction end extension section 55 of the plug fixing member (plug fixing means) 62 is extended in the direction B (opposite direction of the connector 51).

Further, the connector 71 of FIG. 10, having a similar arrangement of the connector 51 (or the connector 61), can be made from the connector 51 (or the connector 61). The connector 71 has a plug fixing member (plug fixing means) 72. The plug fixing member 72 does not include the intermediate extension section 29, and includes the intermediate extension section 30 shorter in length than that of the plug fixing member 52. Accordingly, in the plug fixing member 72, the length between the supporting section 53 and the female engaging section 23 is shorter than that of the plug fixing member 52. For this reason, the connector 71 can be made smaller than the connector 51.

In the connector 51, the guide member 56 guides the movement of the female engaging section 23, and therefore the track of the front end of the female engaging section 23 is a straight line extended in the P-Q direction. In contrast, in the connector 71, the length between the supporting section 53 and the female engaging section 23 is shorter than that of the plug fixing member 52 as thus described, and therefore the track of the front end of the female engaging section 23 is a circular arc extended substantially in the R-S direction.

In order to smoothly carry out this movement of the female engaging section 23 in the R-S direction, the insertion direction end extension section 54 is formed to be a curved shape, and is guided by the guide member 56. The insertion direction end extension section 55 is formed at an end of the insertion direction end extension section 54 by being extended in a direction of the supporting section 53. The catching member 57 is provided by being inclined so that the insertion direction end extension section 55 is previously in contact with the catching member 57 in the front end, or it comes in contact with the catching member 57 firstly in the front end when the female engaging section 23 is shifted in the direction R.

Note that, also in the connector 71, the relation between the first surface 23*a* and the second surface 23*b* of the female engaging section 23, and the removal preventing function for the plug 11 with the relation is the same as that of the connector 21.

In the foregoing arrangement, the operation of the pressed section 24 and the female engaging section 23 when the plug 11 is inserted into the connector 71, and the operation of the pressed section 24 and the female engaging section 23 when the plug 11 is removed from the connector 71 are the same as those of the described connector 41 shown in FIG. 6. However, it should be noted that the connector 71 of the present embodiment uses the elasticity of the insertion direction end extension section 55 as the force (rotation stress) for engaging the female engaging section 23 and the male engaging section 13 of the plug 11, unlike the connector 41 which uses the elasticity of a portion between the pressed section 24 and the supporting section 25 as the engaging force.

Note that, the connector 71 may also have the function for removing the plug 11 from the insertion state into the connector 71 without shifting of the handle section 17 when a great force in the removing direction of the plug 11 is exerted on a connection cable, by having the same arrangement as that of the connector 21.

Further, the connectors 51, 61 and 71 are arranged such that the components such as the guide member 56, the catching member 57 or the insertion direction end extension section 55 are provided on the front end side of the plug 11 (the side of the direction A), and therefore a simple structure is realized for the insertion entrance side of the plug 11 (the side of the direction B). Therefore, the connectors 51, 61 and 71 can provide a simple entrance to an electronic apparatus, thus suitable for an appearance-conscious product.

Further, the connectors 61 and 71 are arranged such that the insertion direction end extension section 55 is folded in the direction B and provided with a corresponding catching member 57. Therefore, the connectors 61 and 71 have less density of the components on the front end side of the plug 11 (the side of the direction A), in comparison with the connector 51.

[Embodiment 3]

The following will explain still another embodiment of the present invention with reference to FIGS. 11 through 17. For ease of explanation, materials having the equivalent functions as those shown in the drawings pertaining to the described embodiments above will be given the same reference symbols, and explanation thereof will be omitted here.

Figure 11:
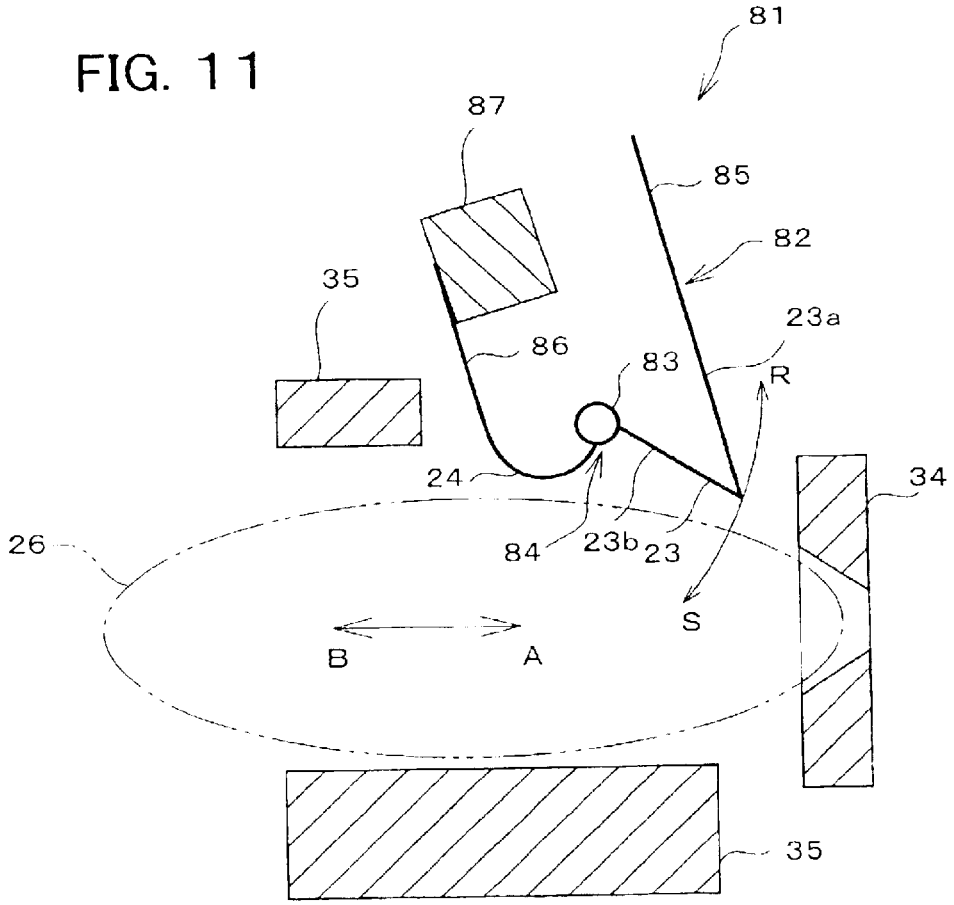
FIG. 11 is a vertical cross-sectional view schematically showing an arrangement of a connector according to still another embodiment of the present invention.

As shown in FIG. 11, the connector 81 of the present embodiment has a plug fixing member (plug fixing means) 82 made of a spring leaf, for example. The plug fixing member 82 has a female engaging section (engaging section) 23, a supporting section (predetermined supporting section) 83, and a pressed section 24 in this order in a removal direction of the plug, i.e., in the direction B. The female engaging section 23 and the pressed section 24 are extended in a direction toward the plug area 26, and the front end of the female engaging section 23 is closer to the plug area 26 than that of the pressed section 24. Further, a depression section 84 is formed between the female engaging section 23 and the pressed section 24 on a portion corresponding to the supporting section 83.

Figure 12:
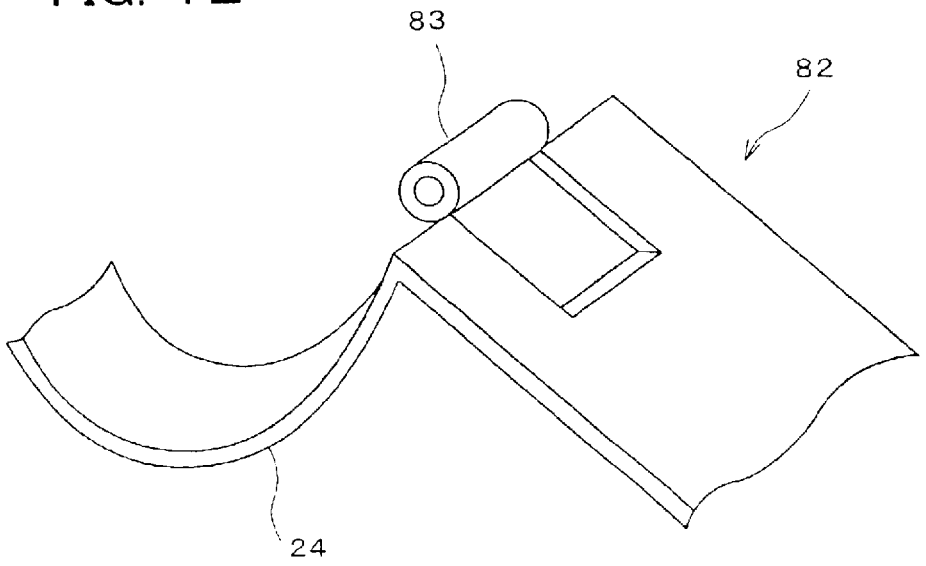
FIG. 12 is a perspective view schematically showing an arrangement example of a supporting section shown in FIG. 11.

The female engaging section 23, the supporting section 83, and the pressed section 24 are provided on one side in the periphery of a plug area 26. The relation between the first surface 23*a* and the second surface 23*b* in the female engaging section 23 is the same as that of the described connector 21: the angle of the first surface 23*a* with respect to the direction A when the plug is completely inserted into the connector 81 is larger than the angle of the second surface 23*b* with respect to the direction B before the plug is inserted into the connector 81. Further, the supporting section 83 is provided between the female engaging section 23 and the pressed section 24. The supporting section 83 supports the plug fixing member 82 to make it rotatable about the supporting section 83. FIG. 12 shows an arrangement example of the supporting section 83. In this arrangement example, to create the supporting section 83, the plug fixing member 82 is partly cut to form a cylindrical section, then is provided in the cylindrical section with an axis member to be the supporting section 83.

Further, in the both ends of the plug fixing member 82, an insertion direction end extension section (extension section) 85 is provided on the side of the female engaging section 23, and a removal direction end extension section 86 is provided on the side of the pressed section 24. The insertion direction end extension section 85 and the removal direction end extension section 86 are provided, for example, substantially in parallel with each other in a direction orthogonal to the A-B direction by being inclined to the direction B.

A guide member 87 is provided on the end of the A direction side of the removal direction end extension section 86 by being in contact with the removal direction end extension section 86.

Figure 13A:
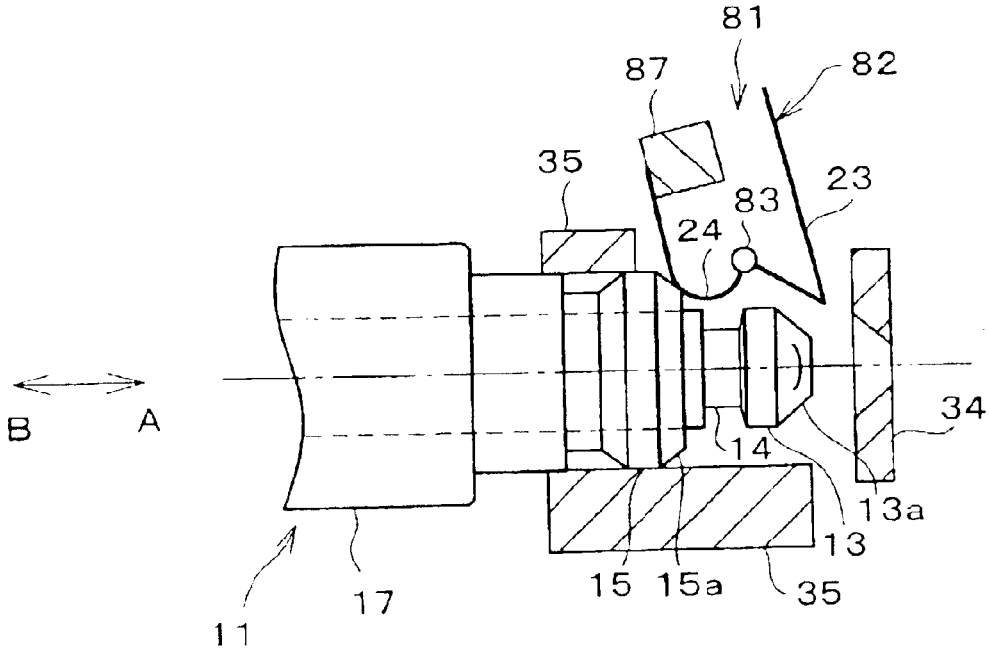
FIG. 13(*a*) is a vertical cross-sectional view schematically showing an initial state of insertion of a plug into the connector shown in FIG. 11.
Figure 13B:
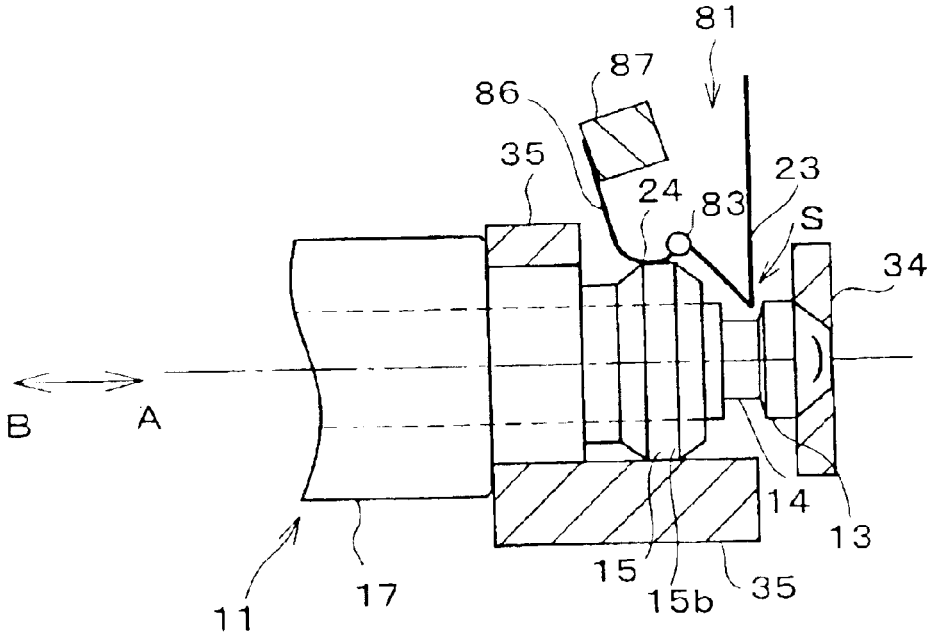

In the foregoing arrangement, when the plug 11 is inserted into the connector 81, the plug 11 is inserted with respect to the connector 81 in the direction A, and with this insertion operation, firstly, the guide member 35 of the connector 81 guides the moving section 15 of the plug 11 to be moved forward, as shown in FIG. 13(*a*).

Secondly, the front sloped surface 13*a* of the male engaging section (unmoving section) 13 of the plug 11 comes in contact with the second surface 23*b* of the female engaging section 23 of the connector 81, and also the front sloped surface 15*a* of the moving section 15 of the plug 11 comes in contact with the pressed section 24 of the connector 81. Note that, here, the male engaging section 13 of the plug 11 may pass through the portion where the female engaging section 23 is provided, without being in contact the female engaging section 23 of the connector 81.

Next, as shown in FIG. 13(*b*), the pressed section 24 of the connector 81 comes on the uniform diameter surface 15*b* having the largest diameter of the moving section 15 of the plug 11. Thus, the pressed section 24 of the connector 81 is pressed by the moving section 15 of the plug 11 and is shifted by being rotated about the supporting section 83. With this operation, a portion of the plug fixing member 82 between the supporting section 83 and the removal direction end extension section 86, for example, the removal direction end extension section 86, is deformed by elasticity and the female engaging section 23 of the connector 81 is rotated about the supporting section 83 in the direction of plug 11 (plug area 26), i.e., the direction S, and gets in the small diameter section 14. As a result, the female engaging section 23 of the connector 81 is engaged with the male engaging section 13 of the plug 11. Consequently, by thus engaging the male engaging section 13 with the female engaging section 23, the removal of the plug 11 from the connector 81 due to pulling force exerted on a connection cable where the plug 11 is provided can be prevented.

Note that, also in the connector 81, the relation between the first surface 23*a* and the second surface 23*b* of the female engaging section 23, and the removal preventing function for the plug 11 with the relation is the same as that of the connector 21.

Next, in order to remove the plug 11, which is in the insertion state into the connector 81 as shown in FIG. 13(*b*), from the connector 81, a user holds the handle section 17 of the plug 11 and pulls the plug 11 in the direction B.

With this operation, the moving section 15 of the plug 11 is moved in the direction B with the handle section 17 of the plug 11 so that the pressed section 24 of the connector 81 is released from the pressing force by the moving section 15, as shown in FIG. 13(*a*). As a result, the pressed section 24 goes back to the original state and the original position due to its elasticity, and the female engaging section 23 of the connector 81 is rotated in the direction R and is disengaged from the male engaging section 13 of the plug 11, which allows the plug 11 to be moved in the direction B, i.e., to be removed from the connector 81.

Note that, the connector 81 may also have the function for removing the plug 11 from the insertion state into the connector 81 without shifting of the handle section 17 when a great force in the removing direction of the plug 11 is exerted on a connection cable where the plug 11 is provided.

This function can be realized, for example, by appropriately adjusting the angle of slope of the first surface 23*a* of the female engaging section 23 of the connector 81 in the insertion state, i.e., the angle of the first surface 23*a* with respect to the direction A. Otherwise, when the plug fixing member 82 is made of a spring leaf, the function can be realized by adjusting the strength of the spring or the strength of the material on a portion between the female engaging section 23 and the supporting section 83.

Figure 14:
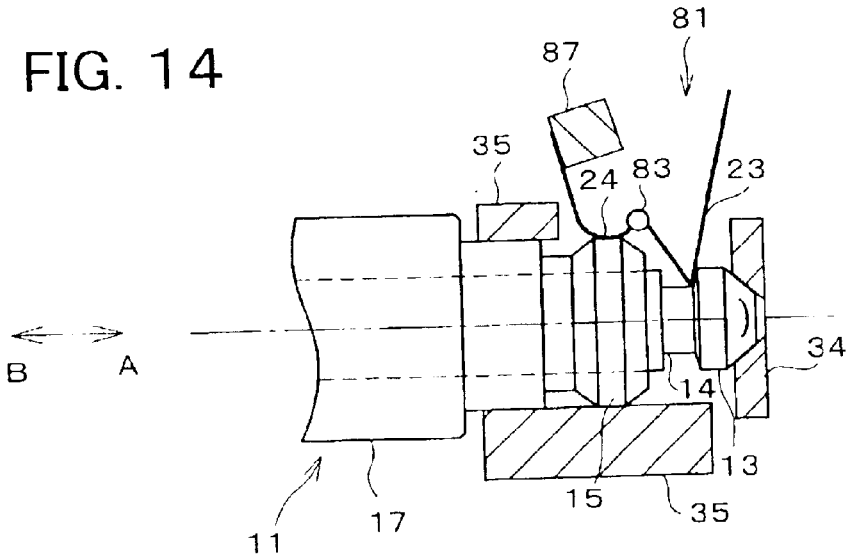
FIG. 14 is a vertical cross-sectional view schematically showing a state where the insertion of the plug into the connector shown in FIG. 11 is completed when a first surface of a female engaging section of the connector is changed in angle.

FIG. 14 shows the female engaging section 23 of the connector 81 whose first surface 23*a* is adjusted to an arbitrary angle. In this example, the angle of the first surface 23*a* with respect to the direction A when the plug is inserted is adjusted to be smaller than the case shown in FIG. 13(*b*) so as to reduce engagement force of the female engaging section 23 with the male engaging section 13. Namely, when the pulling force in the direction B is exerted on the plug 11 (the male engaging section 13), the male engaging section 13 is more easily removed from the engagement state with the female engaging section 23 by a small arcuation of a portion of the plug fixing member 82 between the female engaging section 23 and the supporting section 83.

With the foregoing arrangement, when a great force is exerted on the plug 11, such as a case where one's foot stumbles on the connection cable, it is possible to prevent breakage of the plug 11 and/or the connector 81, and also, to prevent falling and breakage of the electronic apparatus to which the connection cable is connected.

Note that, in the connector 81, the plug fixing member 82 is not necessary to be entirely made of an elastic body, as it requires at least one component made of an elastic body among the components from the supporting section 83 to the removal direction end extension section 86.

Figure 15:
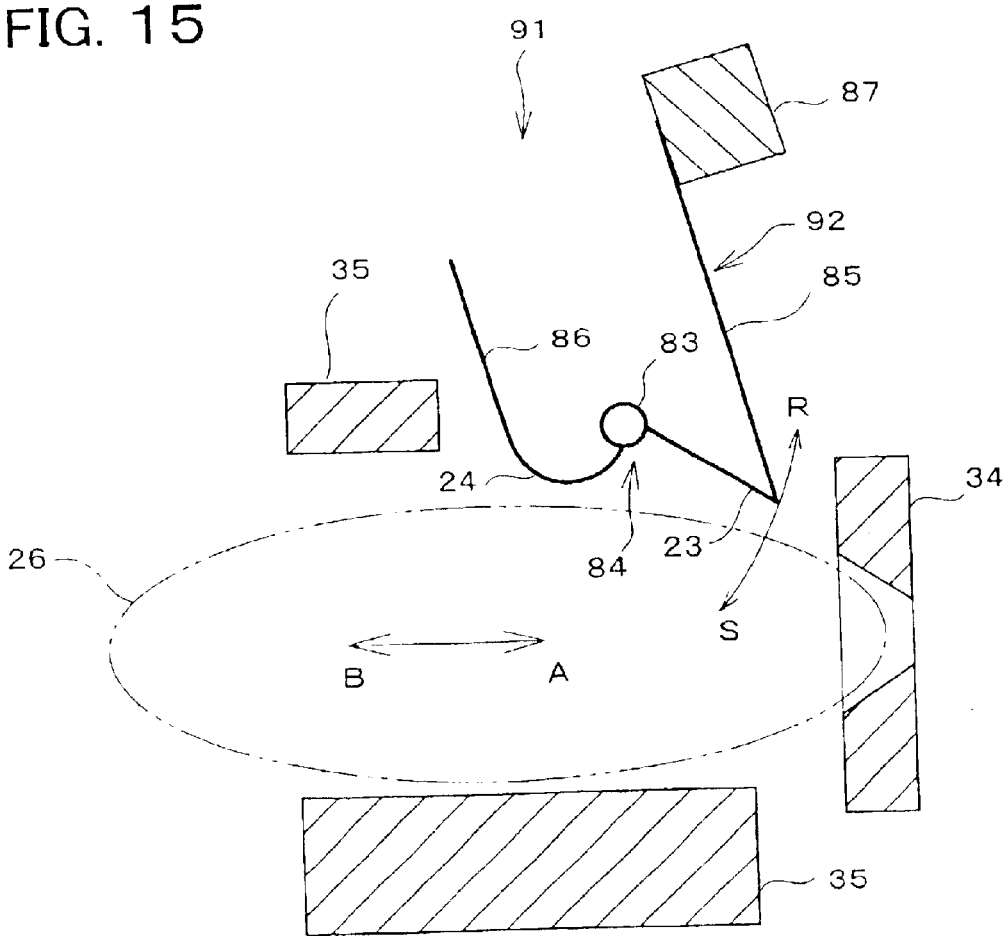
FIG. 15 is a vertical cross-sectional view schematically showing a variation of the connector shown in FIG. 11.

Further, the connector 91 of FIG. 15, having a similar arrangement of the connector 81, can be made from the connector 81. The connector 91 has a plug fixing member (plug fixing means) 92 having the same shape as that of the plug fixing member 82 of the connector 81. However, in contrast to the plug fixing member 82 which requires at least one component made of an elastic body among the components from the supporting section 83 to the removal direction end extension section 86, the plug fixing member 92 has the insertion direction end extension section 85 as the elastic body. Therefore, in the connector 91, the guide member 87 is provided on the end of the A direction side of the insertion direction end extension section 85.

Figure 16A:
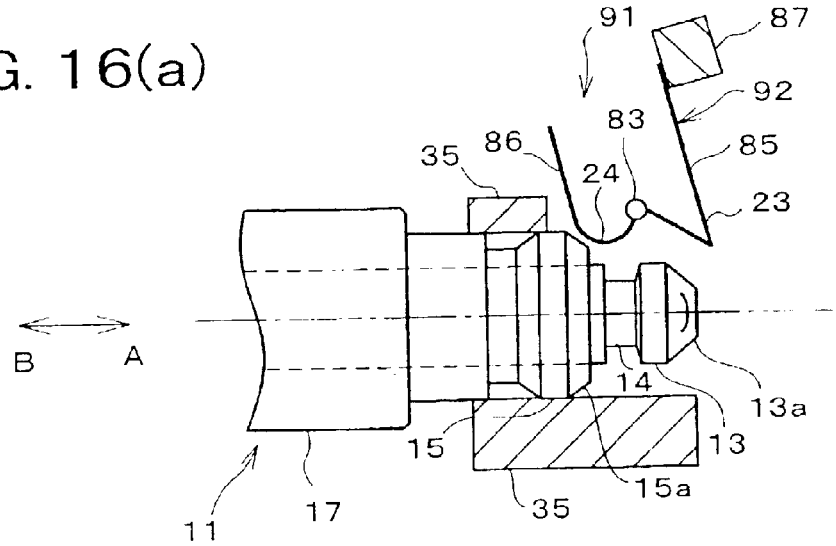
FIG. 16(*a*) is a vertical cross-sectional view schematically showing an initial state of insertion of a plug into the connector shown in FIG. 15.
Figure 16B:
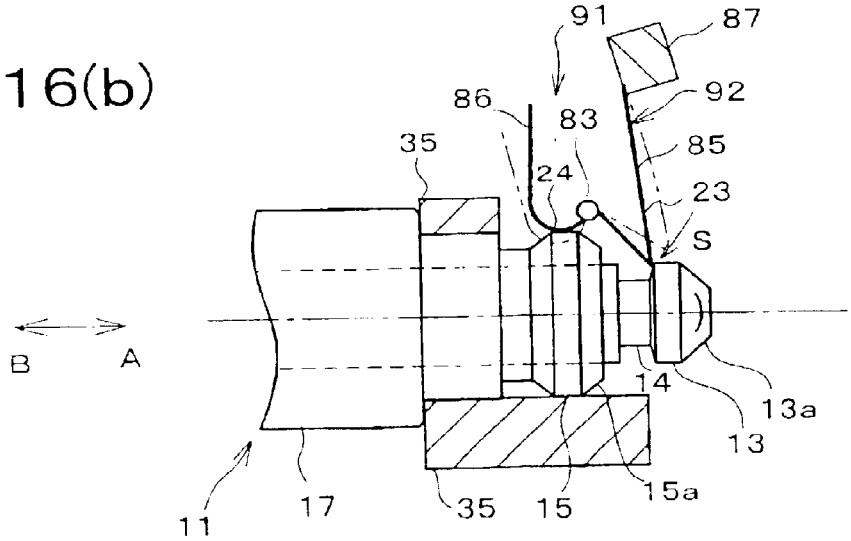
Figure 16C:
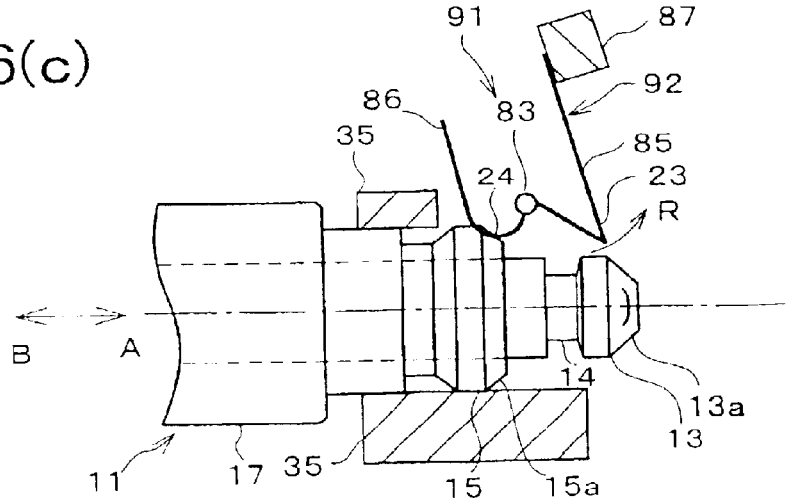

In the foregoing arrangement, the plug 11 is inserted into the connector 91 in the direction A as shown in FIG. 16(*a*). With this insertion operation, the front sloped surface 13*a* of the male engaging section 13 of the plug 11 comes in contact with the second surface 23*b* of the female engaging section 13 of the connector 91, and also the front sloped surface 15*a* of the moving section 15 of the plug 11 comes in contact with the pressed section 24 of the connector 91. Note that, here, the male engaging section 13 of the plug 11 may pass through the portion where the female engaging section 23 is provided, without being in contact the female engaging section 23.

Next, as shown in FIG. 16(*b*), the pressed section 24 of the connector 91 comes on the uniform diameter surface 15*b* having the largest diameter of the moving section 15 of the plug 11. Thus, the pressed section 24 of the connector 91 is rotated about the supporting section 83 by being shifted due to pressing by the moving section 15 of the plug 11. With this operation, the female engaging section 23 of the connector 91 is rotated about the supporting section 83 in the direction of plug 11 (plug area 26), i.e., the direction S, and gets in the small diameter section 14. As a result, the female engaging section 23 of the connector 91 is engaged with the male engaging section 13 of the plug 11. Here, the insertion direction end extension section 85 is bend and curved toward the direction A with its elasticity.

By thus engaging the male engaging section 13 with the female engaging section 23, the removal of the plug 11 from the connector 91 due to pulling force exerted on a connection cable where the plug 11 is provided can be prevented. Note that, also in the connector 91, the relation between the first surface 23*a* and the second surface 23*b* of the female engaging section 23, and the removal preventing function for the plug 11 with the relation is the same as that of the connector 21.

Next, when the handle section 17 of the plug 11, which is in the insertion state into the connector 91 as shown in FIG. 16(*b*), is pulled in the direction B, the moving section 15 of the plug 11 is moved in the direction B with the handle section 17 so that the pressed section 24 of the connector 91 is released from the pressing force by the moving section 15, as shown in FIG. 16(*c*). As a result, the insertion direction end extension section 85 of the connector 91 goes back to the original state and the original position due to its elasticity, and the female engaging section 23 of the connector 91 is rotated in the direction R due to rotation stress caused by the elasticity of the insertion direction end extension section 85. Thus, the female engaging section 23 is disengaged from the male engaging section 13 of the plug 11, which allows the plug 11 to be moved in the direction B, i.e., to be removed from the connector 91.

Note that, the connector 91 may also have the function for removing the plug 11 from the insertion state into the connector 91 without shifting of the handle section 17 when a great force in the removing direction of the plug 11 is exerted on a connection cable where the plug 11 is provided.

Unlike the arrangement of the connector 21 shown in FIG. 1 or the arrangement of the connector 51 shown in FIG. 8 for example, the described connectors 81 and 91 have less density of the components of the connector in the insertion entrance of the plug 11 (the side of the direction B) or the front end side of the plug 11 (the side of direction A), and the components of the connector are gathered in a small area on the central portion of the A-B direction in the plug area 26. Therefore, the connectors 81 and 91 are suitable for an electronic apparatus having components such as a light emitter, a photo receptor, a complicated circuit and/or the like on the front end side of the plug 11 (the side of the direction A). Further, as thus having the gathered components of the connector in a small area, the connectors 81 and 91 can be downsized.

Note that, in the connector 91, the plug fixing member 92 is not necessary to be entirely made of an elastic body, as it requires at least the insertion direction end extension section 85 as the component of elastic body.

Figure 17:
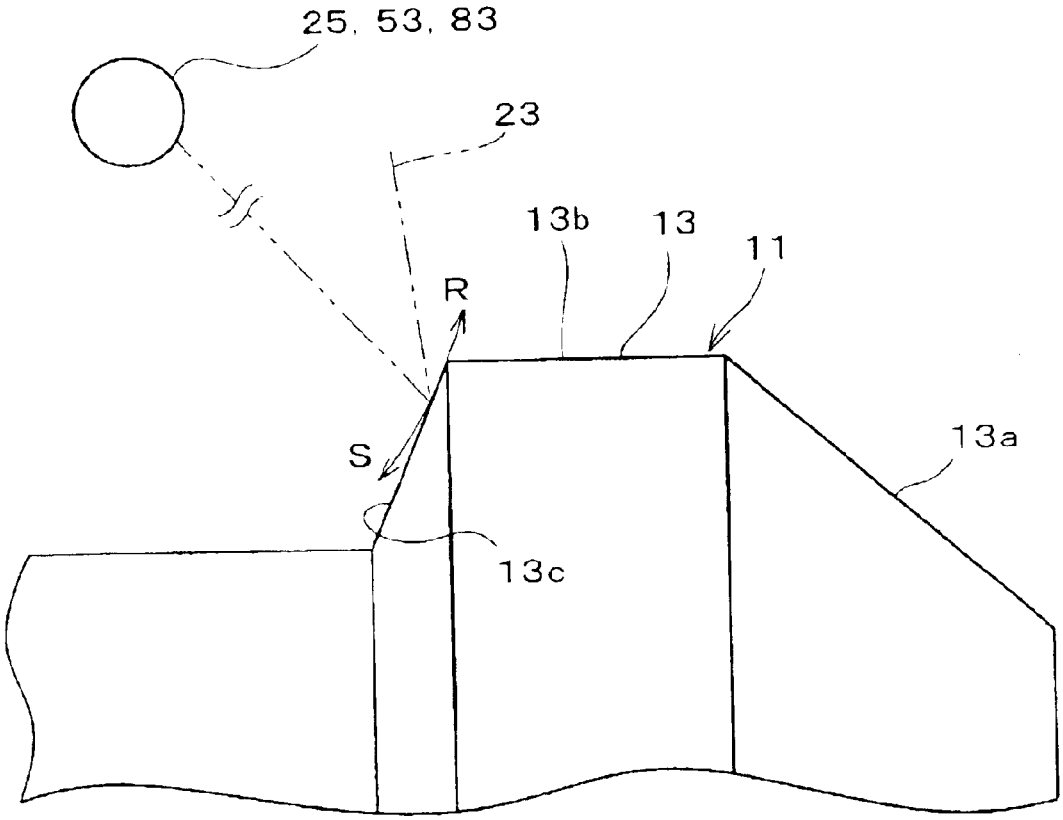
FIG. 17 is an explanatory view showing the position of the supporting section of the connector in one embodiment of the present invention where the female engaging section is rotated about the supporting section so as to be disengaged from the male engaging section of the plug.

Further, as shown in FIG. 17, in the described connectors 41, 71, 81, and 91 having the arrangement such that the female engaging section 23 is rotated about the supporting section so as to be engaged/removed with/from the male engaging section 13 of the plug 11, the supporting section (25, 53, 83) is provided on a center of the circle in contact with the back surface 13*c* of the male engaging section 13 of the plug 11. On this account, it is possible to smoothly carry out the engagement/removal of the female engaging section 23 with respect to the male engaging section 13 of the plug 11. Note that, the position of the supporting sections 25, 53, and 83 is not limited to the center of the circle, and they may be provided on an area closer to the axis center side of the plug 11 than the center of the circle.

[Embodiment 4]

The following will explain yet another embodiment of the present invention with reference to FIGS. 18 through 21. For ease of explanation, materials having the equivalent functions as those shown in the drawings pertaining to the described embodiments above will be given the same reference symbols, and explanation thereof will be omitted here.

Figure 18:
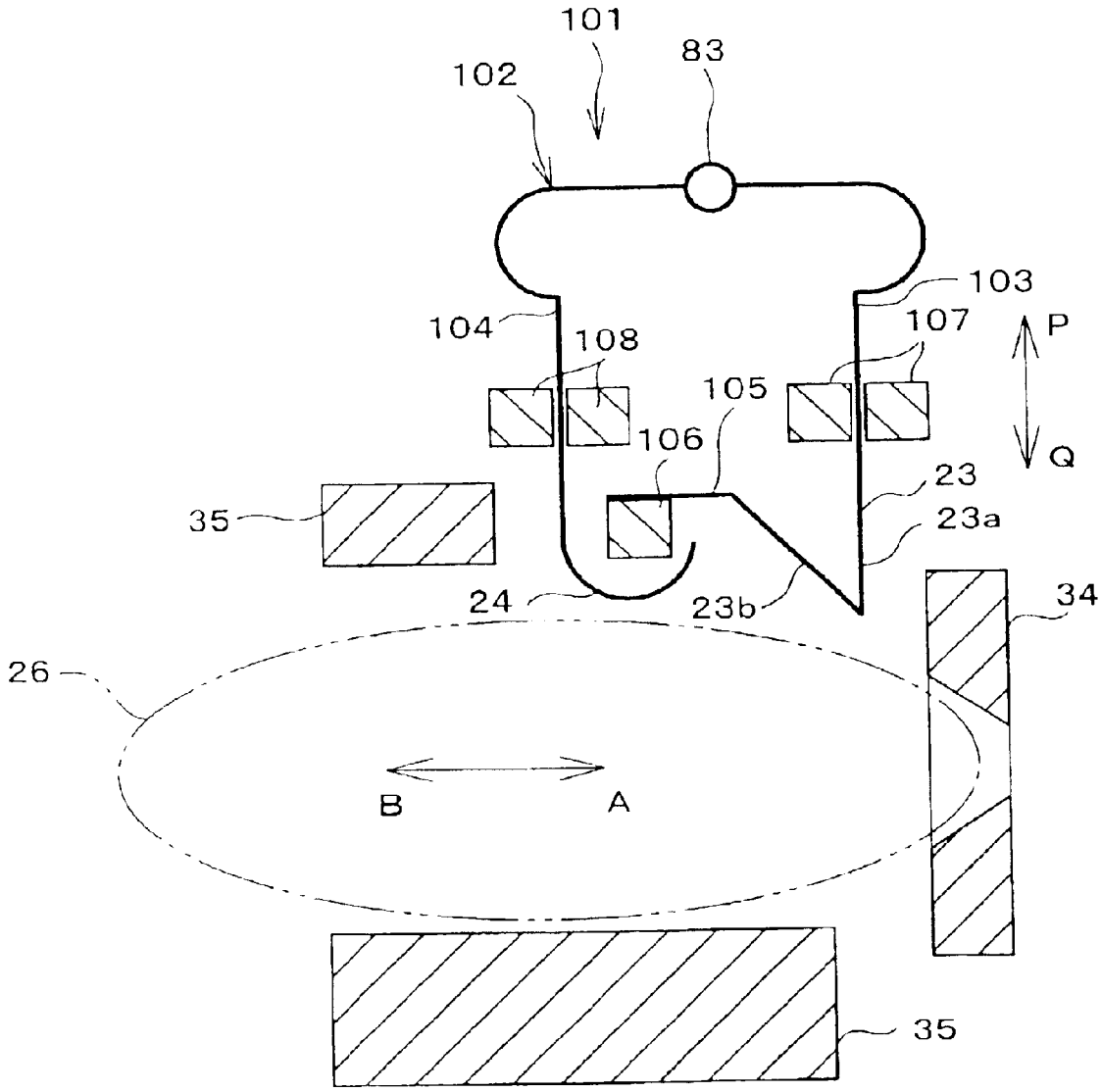
FIG. 18 is a vertical cross-sectional view schematically showing an arrangement of a connector according to yet another embodiment of the present invention.

As shown in FIG. 18, the connector 101 of the present embodiment has a plug fixing member (plug fixing means) 102 made of a spring leaf, for example. The plug fixing member 102 has a female engaging section (engaging section) 23, a supporting section (predetermined supporting section) 83, and a pressed section 24 in this order in a removal direction of the plug, i.e., in the direction B. The female engaging section 23 and the pressed section 24 are extended in a direction toward the plug area 26.

The female engaging section 23, the supporting section 83, and the pressed section 24 are provided on one side in the periphery of a plug area 26. Further, the relation between the first surface 23*a* and the second surface 23*b* in the female engaging section 23 is the same as that of the described connector 21: the angle of the first surface 23*a* with respect to the direction A when the plug is completely inserted into the connector 101 is larger than the angle of the second surface 23*b* with respect to the direction B before the plug is inserted into the connector 101. The supporting section 83 is provided between the female engaging section 23 and the pressed section 24, and the supporting section 83 supports the plug fixing member 102 to make it rotatable about the supporting section 83.

An intermediate extension section 103 is provided between the female engaging section 23 and the supporting section 83, and an intermediate extension section 104 is provided between the supporting section 83 and the pressed section 24. The intermediate extension section 103 is extended from the female engaging section 23 toward the direction P, then further extended toward the direction B to be reached to the supporting section 83. The intermediate extension section 104 is extended from the pressed section 24 toward the direction P, then further extended toward the direction A to be reached to the supporting section 83.

Further, an engagement end side extension section 105 is provided on the end of the plug fixing member 102 on the female engaging section 23 side. The engagement end side extension section 105 is extended from the female engaging section 23 toward the direction B and reaches to the P direction side of the pressed section 24. A pressing transmission member 106 is provided on the pressed section 24 side of the engagement end side extension section 105.

The intermediate extension sections 103 and 104 are movable in the P-Q direction, and their movements are respectively guided by the guide members 107 and 108.

As described, though the plug fixing member 102 greatly differs in the form from the plug fixing member 82 of the connector 81, the operation principle is substantially the same as that of the connector 81. Note that, the plug fixing member 102 is not necessary to be entirely made of an elastic body, as it requires at least the supporting section 83 side of the intermediate extension sections 103 and 104 (for example, the curved portion shown in FIG. 18), and the engagement end side extension section 105 to be made of an elastic body. Further, it may be arranged such that only the engagement end side extension section 105 is made of an elastic body.

Figure 19A:
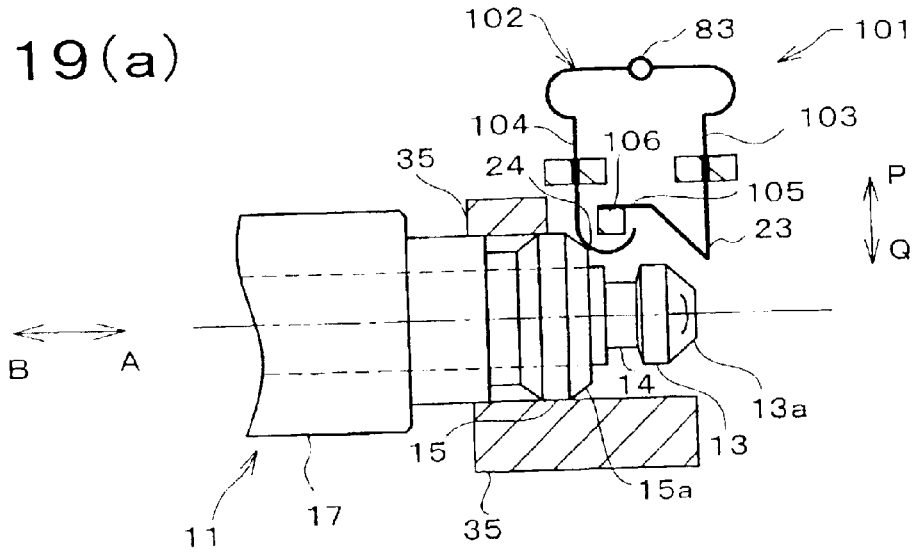
FIG. 19(*a*) is a vertical cross-sectional view schematically showing an initial state of insertion of a plug into the connector shown in FIG. 18.
Figure 19B:
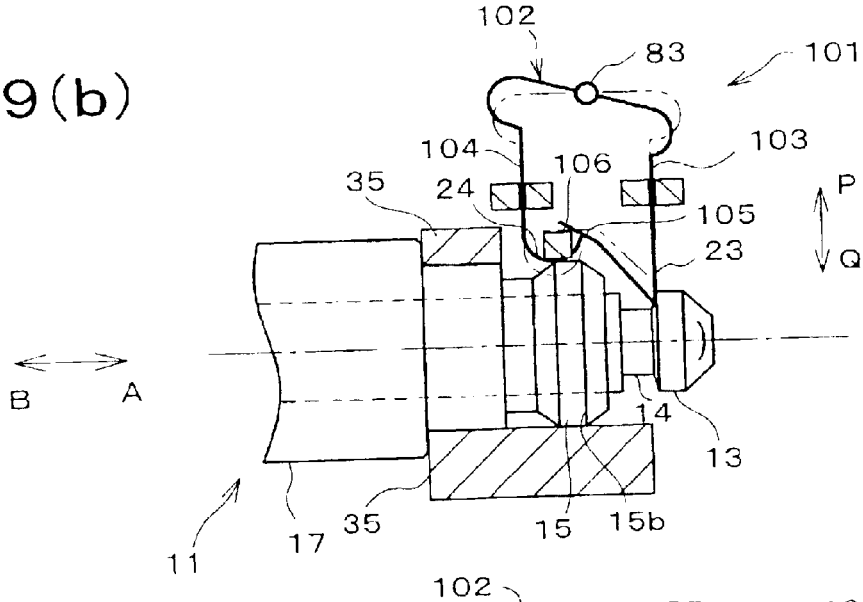
Figure 19C:
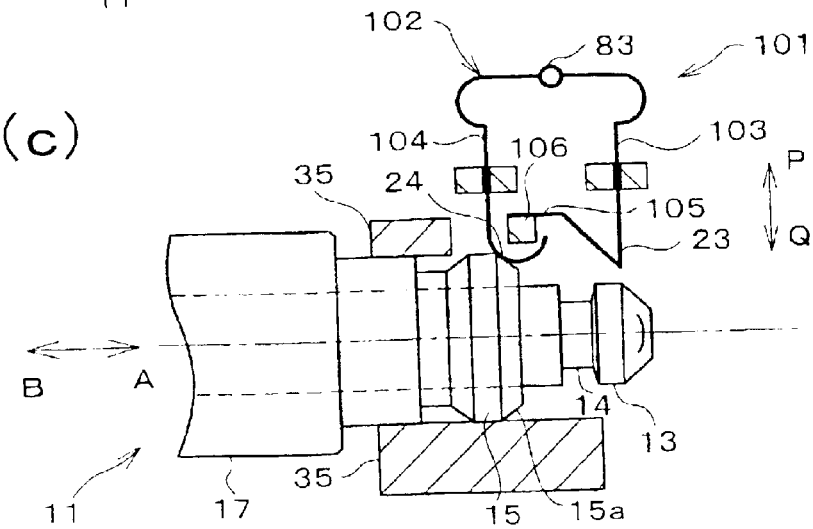

In the foregoing arrangement, when the plug 11 is inserted into the connector 101, the plug 11 is inserted with respect to the connector 101 in the direction A, and with this insertion operation, firstly, the guide member 35 of the connector 101 guides the moving section 15 of the plug 11 to be moved forward, as shown in FIG. 19(*a*).

Secondly, the front sloped surface 13*a* of the male engaging section (unmoving section) 13 of the plug 11 comes in contact with the second surface 23*b* of the female engaging section 23 of the connector 101, and also the front sloped surface 15*a* of the moving section 15 of the plug 11 comes in contact with the pressed section 24 of the connector 101. Note that, here, the male engaging section 13 of the plug 11 may pass through the portion where the female engaging section 23 is provided, without being in contact the female engaging section 23.

Next, as shown in FIG. 19(*b*), the pressed section 24 of the connector 101 comes on the uniform diameter surface 15*b* having the largest diameter of the moving section 15 of the plug 11. Thus, the engagement end side extension section 105 of the connector 101 is pressed by the moving section 15 of the plug 11 through the pressed section 24 and the pressing transmission member 106, and is deformed in the direction P. Further, the moving section 15 of the plug 11 presses the pressed section 24 and the intermediate extension section 104 of the connector 101 to be moved in the direction P. With this operation, the intermediate extension section 103 and the female engaging section 23 are moved in the direction Q, and the female engaging section 23 gets in the small diameter section 14. As a result, the female engaging section 23 is engaged with the male engaging section 13 of the plug 11. Consequently, by thus engaging the male engaging section 13 with the female engaging section 23, the removal of the plug 11 from the connector 101 due to pulling force exerted on a connection cable where the plug 11 is provided can be prevented.

Note that, also in the connector 101, the relation between the first surface 23*a* and the second surface 23*b* of the female engaging section 23, and the removal preventing function for the plug 11 with the relation is the same as that of the connector 21.

Next, in order to remove the plug 11, which is in the insertion state into the connector 101 as shown in FIG. 19(*b*), from the connector 101, a user holds the handle section 17 of the plug 11 and pulls the plug 11 in the direction B.

With this operation, the moving section 15 of the plug 11 is moved in the direction B with the handle section 17 of the plug 11 so that the pressed section 24 of the connector 101 is released from the pressing force by the moving section 15 of the plug 11, as shown in FIG. 19(*c*). As a result, the pressed section 24 and the female engaging section 23 go back to the original state and the original position due to recovery force (rotation stress) because of the elasticity of the intermediate extension sections 103 and 104, and a force (rotation stress) of the engagement end side extension section 105 because of its elasticity exerted on the pressed section 24 in the Q direction via the pressing transmission member 106, otherwise, only due to the latter, i.e., the rotation stress of the engagement end side extension section 105. Consequently, the female engaging section 23 is disengaged from the male engaging section 13 of the plug 11, which allows the plug 11 to be moved in the direction B, i.e., to be removed from the connector 101.

Note that, the connector 101 may also have the function for removing the plug 11 from the insertion state into the connector 101 without shifting of the handle section 17 when a great force in the removing direction of the plug 11 is exerted on a connection cable where the plug 11 is provided.

This function can be realized by appropriately adjusting the angle of slope of the first surface 23*a* of the female engaging section 23 of the connector 101 in the insertion state, i.e., the angle of the first surface 23*a* with respect to the direction A. Otherwise, when the plug fixing member 102 is made of a spring leaf, the function can be realized by adjusting the strength of the spring or the strength of the material on a portion between the female engaging section 23 and the supporting section 83.

Figure 20:
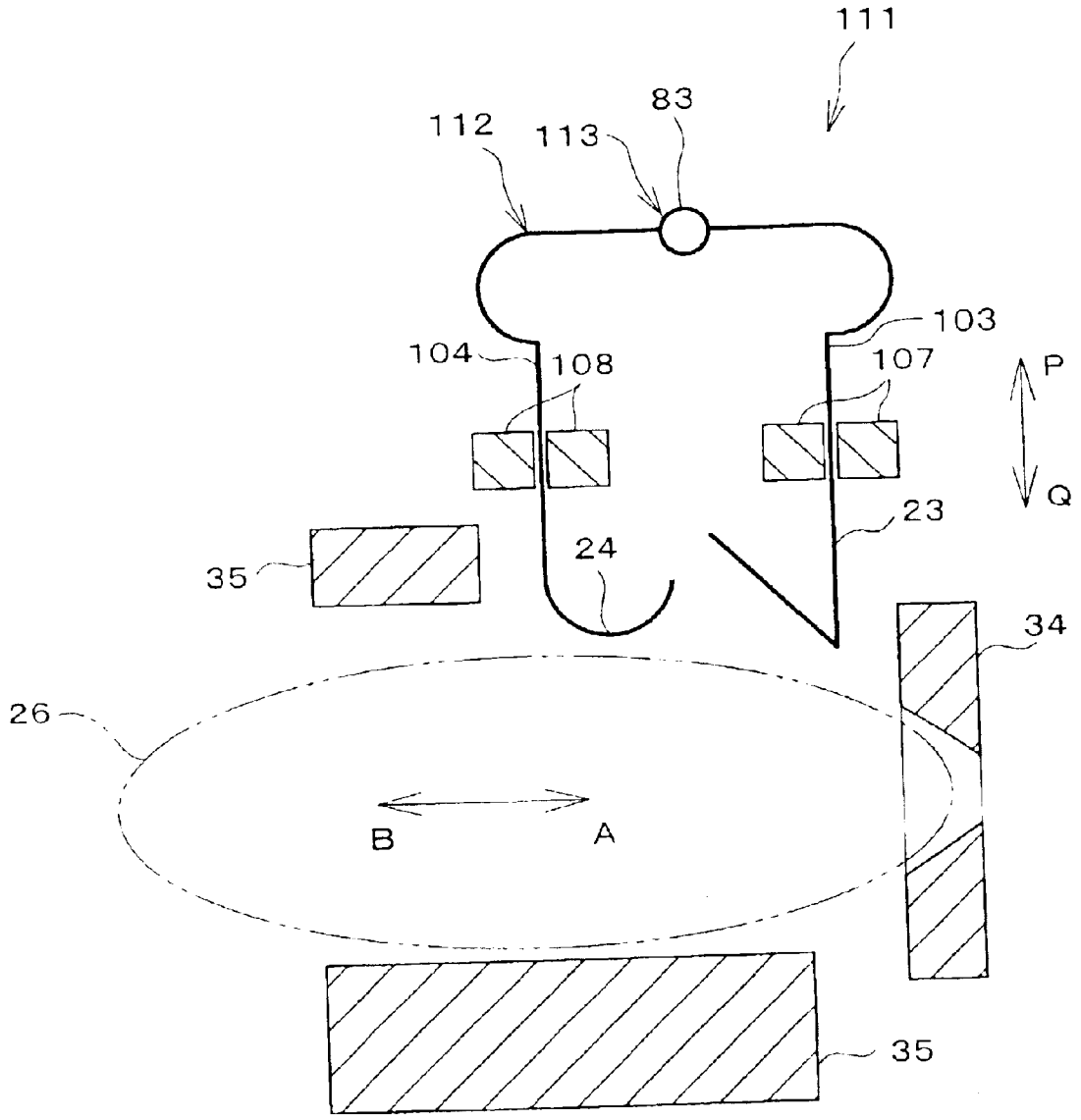
FIG. 20 is a vertical cross-sectional view schematically showing a variation of the connector shown in FIG. 18.
Figure 21:
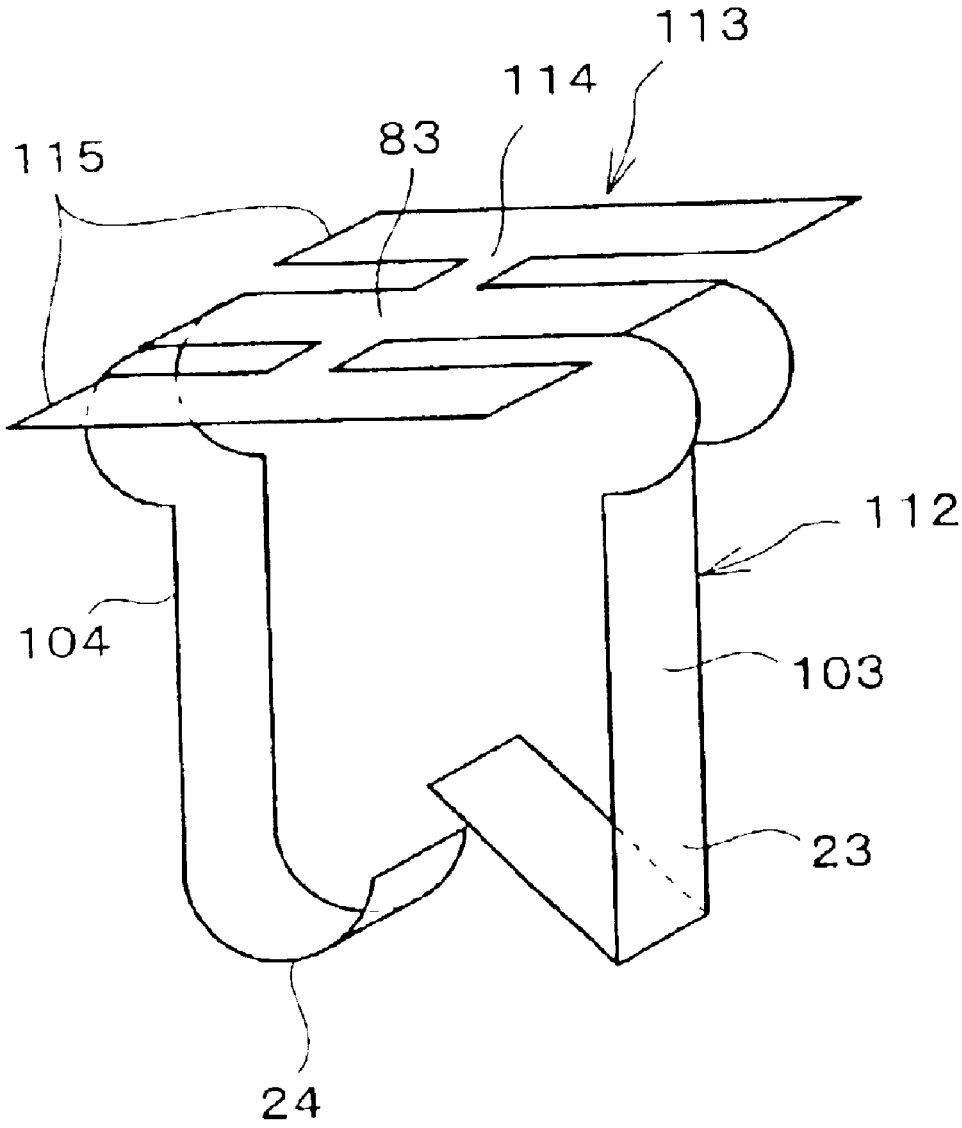
FIG. 21 is a perspective view showing a plug fixing member of the connector shown in FIG. 20.

Further, the connector 111 of FIG. 20, having a similar arrangement of the connector 101, can be made from the connector 101. The connector 111 has a plug fixing member (plug fixing means) 112. The plug fixing member 112 does not include the engagement end side extension section 105, which was provided in the plug fixing member 102, but includes a recovery force supplying section 113 in the supporting section 83, as shown in FIG. 21. The recovery force supplying section 113 includes a supporting axis direction extension section 114 and an attachment section 115. The supporting axis direction extension section 114 is made of an elastic body, and is provided on the supporting section 83 in its axis direction. The attachment section 115 has a plate shape, and is respectively provided on both ends of the supporting axis direction extension section 114. Accordingly, the plug fixing member 112 is attached inside of the connector 111 by the attachment section 115.

In the connector 111, when the plug 11 is inserted and the pressed section 24 is pressed by the moving section 15 of the plug 11 (the state shown in FIG. 19(*b*)), the female engaging section 23 of the connector 111 is engaged with the male engaging section 13 of the plug 11, and the removal of the plug 11 in the direction B from the connector 111 is prevented, as with the connector 101.

Here, in the recovery force supplying section 113, a portion around the supporting section 83 of the intermediate extension sections 103 and 104 is rotated about the supporting section 83, and therefore the supporting axis direction extension section 114 is twisted by this rotation. Thus, when the moving section 15 of the plug 11 is pulled in the direction B and the pressed section 24 is released from the pressing by the moving section 15, a force (rotation stress) for releasing the supporting axis direction extension section 114 from the twisted state is exerted, and the female engaging section 23 goes back to the original position. As a result, the female engaging section 23 of the connector 111 is disengaged from the male engaging section 13 of the plug 11. Here, the recovery force of the intermediate extension sections 103 and 104 may of course be used for this operation.

In a comparison of the connector 111, and the connector 101 shown in FIG. 18, in the connector 101, the engagement end side extension section 105 for obtaining the recovery force is provided in a small area. On the other hand, in the connector 111, the recovery force supplying section 113 is provided in a large area, thus more easily preparing the plug fixing member 112. Also, operation stability can be increased. However, the connector 101 is more suitable for downsizing than the connector 111.

Note that, the relation between the first surface 23*a* and the second surface 23*b* of the female engaging section 23, and the removal preventing function for the plug 11 with the relation is the same as that of the connector 21.

Further, the connector 111 also can provide the function for removing the plug 11 from the insertion state into the connector 111 without shifting of the handle section 17 when a great force in the removing direction of the plug 11 is exerted on a connection cable, by having the same arrangement as that of the connector 81.

Further, as with the described connector 81 and 91, the connectors 101 and 111 have less density of the components of the connector in the insertion entrance of the plug 11 (the side of the direction B) or the front end side of the plug 11 (the side of direction A), and the components of the connector are gathered in a small area on the central portion of the A-B direction in the plug area 26. Therefore, the connectors 101 and 111 are suitable for an electronic apparatus having components such as a light emitter, a photo receptor, a complicated circuit and/or the like on the front end side of the plug 11 (the side of the direction A).

[Embodiment 5]

The following will explain further embodiment of the present invention with reference to FIGS. 22 through 25. For ease of explanation, materials having the equivalent functions as those shown in the drawings pertaining to the described embodiments above will be given the same reference symbols, and explanation thereof will be omitted here.

Figure 22:
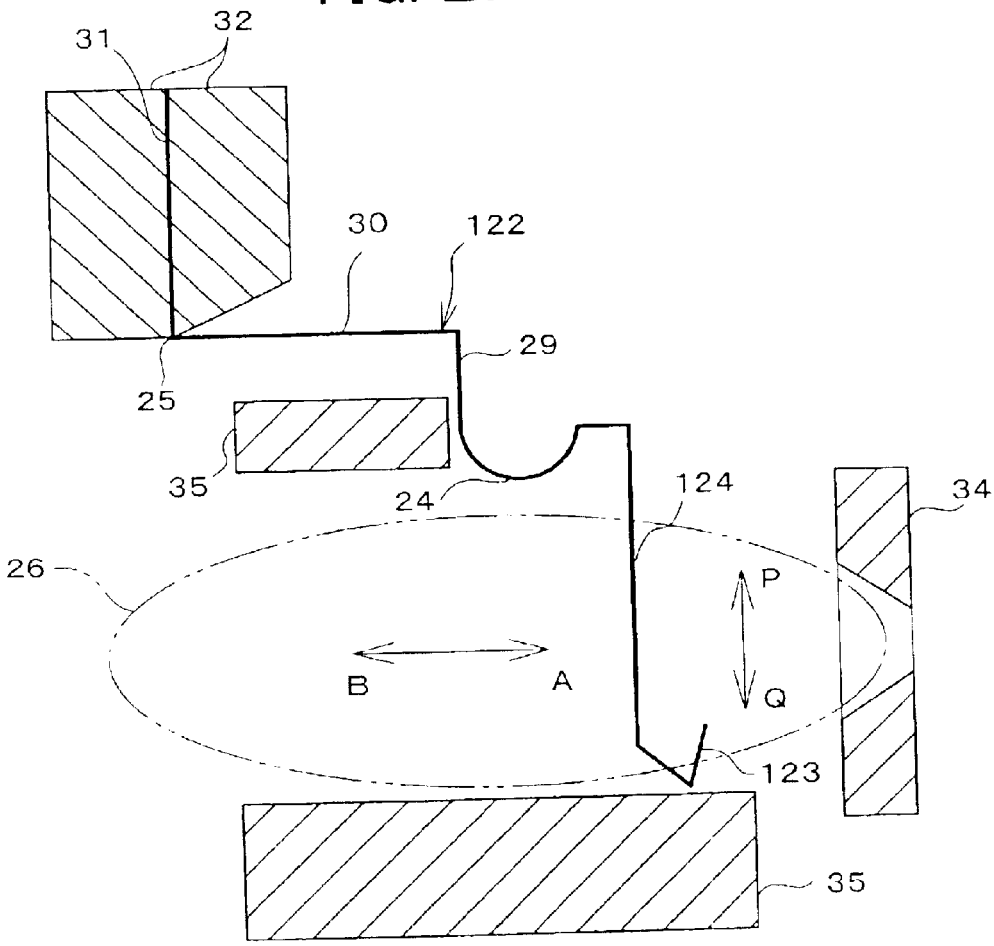
FIG. 22 is a vertical cross-sectional view schematically showing an arrangement of a connector according to further embodiment of the present invention.

As shown in FIG. 22, the connector 121 of the present embodiment has a plug fixing member (plug fixing means) 122 made of a spring leaf, for example. The plug fixing member 122 has a female engaging section (engaging section) 123, a pressed section 24, and a supporting section (predetermined supporting section) 25 in this order in a removal direction of the plug, i.e., in the direction B. Among these components, the pressed section 24 and the supporting section 25 are provided on one side in the periphery of a plug area 26, and the female engaging section 123 is provided on the opposite side of the side having the pressed section 24 and the supporting section 25 with respect to the plug area 26.

An intermediate extension section 124 extended in the P-Q direction is provided between the female engaging section 123 and the pressed section 24, and intermediate extension sections 29 and 30 are provided between the pressed section 24 and the supporting section 25. Further, the plug fixing member 122 is supported by having a removal direction end extension section 31 carried by carrying members 32, as with the connector 21 shown in FIG. 1. This arrangement allows the plug fixing member 122, with respect to the area from the supporting section 25 toward the direction A, to be moved in the P-Q direction due to elastic deformation and the recovery stress (rotation stress) for recovering from the deformation of the supporting section 25 or the intermediate extension section 30.

Further, in the connector 121, the plug fixing member 122 is not necessary to be entirely made of an elastic body, as it requires at least one component of elastic body among the supporting section 25, the intermediate extension section 30, the intermediate extension section 29, and the pressed section 24.

Figure 23:
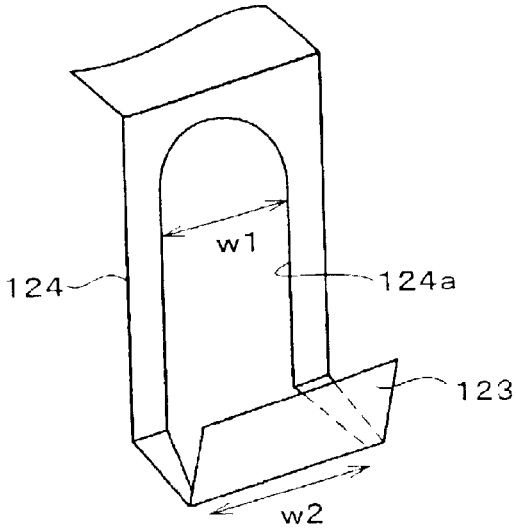
FIG. 23 is a perspective view showing an intermediate extension section and a female engaging section of the connector shown in FIG. 22.

As shown in FIG. 23, a plug through hole 124*a* is provided in the intermediate extension section 124 for allowing the male engaging section (unmoving section) 13 of the plug 11 to go through therein. In the figure, W1 denotes the width of the plug through hole 124*a* on the side of the pressed section 24, and W2 denotes the width in the periphery of the connection section with the female engaging section 123.

The female engaging section 123 is formed on an end of the plug fixing member 122 from an end of the intermediate extension section 124. The female engaging section 123 is extended toward the center of the plug area 26 while being inclined in the direction A, with respect to its end connected to the intermediate extension section 124.

Figure 24A:
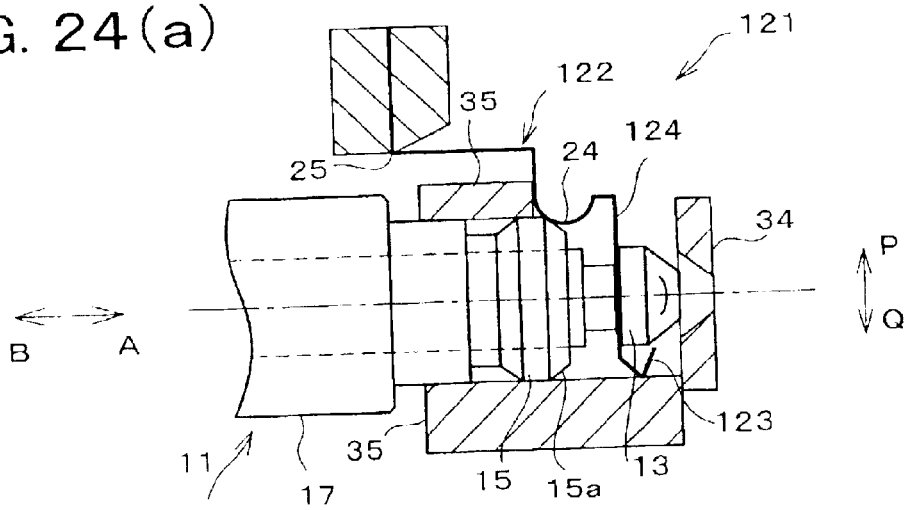
FIG. 24 (*a*) is a vertical cross-sectional view schematically showing an initial state of insertion of a plug into the connector shown in FIG. 22.
Figure 24B:
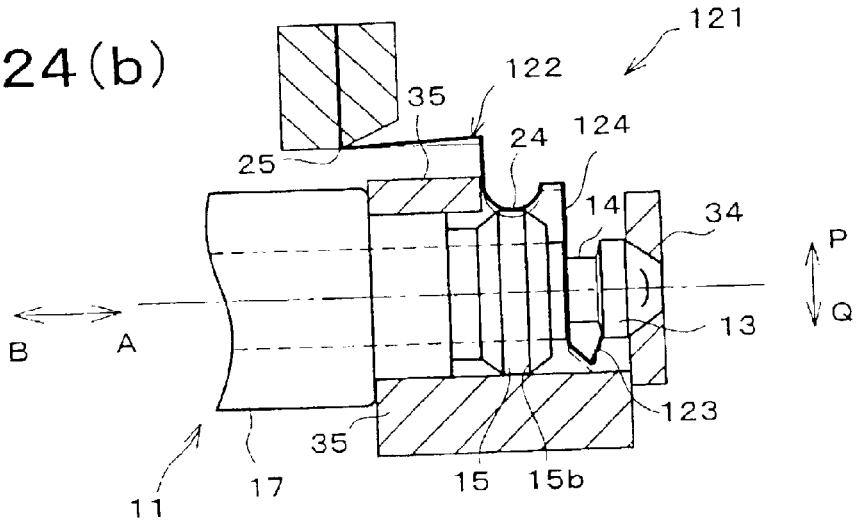
Figure 24C:
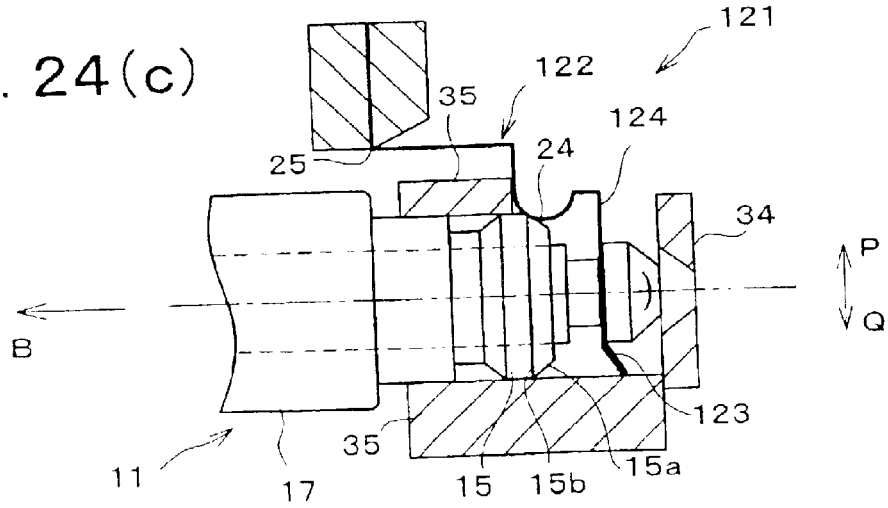

In the foregoing arrangement, when the plug 11 is inserted into the connector 121, firstly, the guide member 35 of the connector 121 guides the moving section 15 and the intermediate section 16 of the plug 11 to be moved forward, and the front sloped surface 15*a* of the moving section 15 becomes in contact with the pressed section 24, as shown in FIG. 24(*a*). At this point, the male engaging section 13 of the plug 11 has passed through the plug through hole 124*a* in the intermediate extension section 124 of the connector 121.

Secondly, as shown in FIG. 24(*b*), the pressed section 24 of the connector 121 comes on the uniform diameter surface 15*b* having the largest diameter of the moving section 15 of the plug 11. Thus, the pressed section 24 of the connector 121 is pressed by the moving section 15 of the plug 11 to be moved in the direction P. With this operation, the female engaging section 123 is moved in the direction P and gets in the small diameter section 14 of the plug 11. As a result, the female engaging section 123 is engaged with the back end, i.e., the back sloped surface 13*c* of the male engaging section 13. Consequently, by thus engaging the male engaging section 13 with the female engaging section 123, the removal of the plug 11from the connector 121 due to pulling force exerted on a connection cable where the plug 11 is provided can be prevented.

Next, when the handle section 17 of the plug 11, which is in the insertion state into the connector 121 as shown in FIG. 24(*b*), is pulled in the direction B, the moving section 15 of the plug 11 is moved in the direction B with the handle section 17 so that the pressed section 24 of the connector 121 is released from the pressing force by the moving section 15 of the plug 11, as shown in FIG. 24(*a*). As a result, the female engaging section 123 is moved in the direction Q, and is disengaged from the male engaging section 13, thus allowing the plug 11 to be moved in the direction B.

Further, in the insertion state of the plug 11 into the connector 121 shown in FIG. 24(*b*), the female engaging section 123, which is in the engagement state with the male engaging section of the plug 11, is extended toward the center of the plug area 26 while being inclined in the direction A, with respect to its end connected to the intermediate extension section 124, as thus described. Accordingly, the female engaging section 123 is in contact with the male engaging section 13 in its front end section. On this account, the easy removal of the plug 11 from the connector 121 due to pulling force exerted on a connection cable where the plug 11 is provided can be prevented.

Note that, the connector 121 may have the function for removing the plug 11 from the insertion state into the connector 121 without shifting of the handle section 17 when a great force in the removing direction of the plug 11 is exerted on a connection cable where the plug 11 is provided.

In this case, as shown in FIG. 24(*c*), the female engaging section 123 of the connector 121 is folded due to the movement of the male engaging section 13 of the plug 11 in the direction B, and the female engaging section 123 is disengaged from the male engaging section 13. In order to ease this disengagement, the connector 121 is provided with the plug through hole 124*a* in the intermediate extension section 124, whose width is respectively adjusted to W1 for the side of the pressed section 24, and to W2 for the periphery of the connection section with the female engaging section 123. Namely, this arrangement can reduce the practical width of the intermediate extension section 124 in the periphery of the connection section with the female engaging section 123 so as to allow the female engaging section 123 to be more easily folded on that section. Note that, by adjusting the width W2 of the plug through hole 124*a*, it is possible to adjust removal easiness of the plug 11.

Since the connector 121 has the female engaging section 123 capable of being folded as thus described, when a great force is exerted on the plug 11, such as a case where one's foot stumbles on the connection cable, it is possible to prevent breakage of the plug 11 and/or the connector 121, and also, to prevent falling and breakage of the electronic apparatus to which the connection cable is connected.

Further, when the plug 11 is removed from the connector 121 without moving the moving section 15 such as the foregoing case (hereinafter referred to as removal without moving the moving section), the female engaging section 123 is folded so that the other area (the area other than the female engaging section 123 of the plug fixing member 122) is protected from a great load. The connector 121 has superior effect of this function that the other described connectors.

More specifically, in the other described connectors (the connectors other than the connector 121), a great load is exerted on the area between the female engaging section 23 and the supporting section 25, 53, or 83 when the removal without moving the moving section occurs. Also, those sections operate to transmit the movement for enabling the female engaging section 23 to be inserted/removed into/from the male engaging section 13 of the plug 11. Therefore, the other connectors have to be designed with consideration of elasticity limit with respect to the large area between the female engaging section 23 and the supporting section 25, 53, or 83. On the other hand, the connector 121 requires consideration of elasticity limit only with respect to the female engaging section 123 (the connection part of the female engaging section 123 and the intermediate extension section 124), thus realizing easy designing.

Further, the connector 121 is superior in the function of stably fixing the plug 11 in the insertion state into the connector 121 than the other described connectors.

More specifically, the connectors other than the connector 121 are arranged such that the female engaging section 23 and the supporting section 25, 53, or 83 are provided on one side in the periphery of a plug area 26. For this reason, those connectors are suitable for downsizing.

On the other hand, in those connectors, the distance between the female engaging section 23 and the supporting section 25, 53, or 83 is shorter in the direction (P-Q direction) orthogonal to the removal direction of the plug 11 (A-B direction). Accordingly, even though those connectors can suitably carry out the engagement of the female engaging section 23 with the male engaging section 13 of the plug 11, i.e., can prevent removal of the plug 11 as with the connector 121, a bias force for fixing the plug 11 in a certain position, i.e., a bias force from the female engaging section 23 in the direction A with respect to the male engaging section 13 of the plug 11 is relatively small compared to the connector 121.

In contrast, in the connector 121, the female engaging section 123 is provided to be opposite to the supporting section 25 in the periphery of the plug area 26, and the distance between the female engaging section 123 and the supporting section 25 in the P-Q direction is longer than those of the other connectors. With this arrangement, elasticity of the area having longer distance can easily provide a bias force in the direction A with respect to the male engaging section 13 of the plug 11. Consequently, it is possible to stably fix the plug 11 in a certain position.

Figure 25:
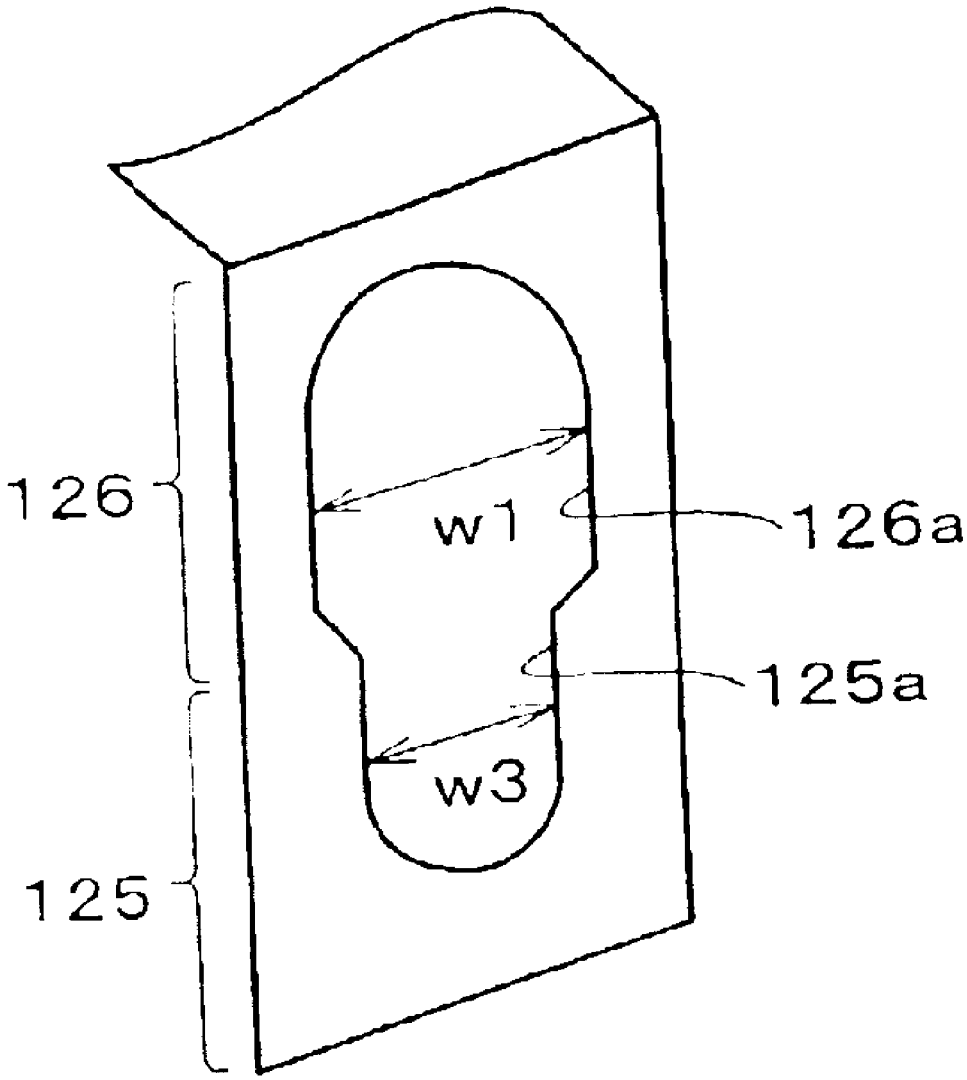
FIG. 25 is a perspective view showing other examples of the intermediate extension section and the female engaging section shown in FIG. 23.

Further, the connector 121 may include a female engaging section (engaging section) 125 and an intermediate extension section 126 as shown in FIG. 25, instead of the described female engaging section 123 and the intermediate extension section 124. The intermediate extension section 126 corresponds to the intermediate extension section 124. The female engaging section 125 is provided on a portion lower than the intermediate extension section 126, and has an engaging hole 125*a* continuous to a plug through hole 126*a* of the intermediate extension section 126.

As with the plug through hole 124*a*, the width W1 of the plug through hole 126*a* is adjusted to allow the male engaging section 13 of the plug 11 to pass through therein. Further, the width w3 of the engaging hole 125*a* is adjusted for allowing the small diameter section 14 of the plug 11 to pass through therein, and preventing the male engaging section 13 from passing through therein.

With the foregoing arrangement, when the plug 11 is inserted into the connector 121, and the pressed section 24 of the connector 121 comes on the uniform diameter surface 15*b* having the largest diameter of the moving section 15 of the plug 11, the small diameter section 14 of the plug 11 gets in the engaging hole 125*a* of the female engaging section 125 for preventing removal of the plug 11 from the connector 121 in the direction B.

Further, when the moving section 15 of the plug 11 is moved in the direction B, the pressed section 24 is released from the pressing by the moving section 15, and the plug through hole 126*a* of the intermediate extension section 126 of the connector 121 is moved on the small diameter section 14 of the plug 11. This operation allows the male engaging section 13 of the plug 11 to be removed from the plug through hole 126*a*, i.e., to be removed from the connector 121.

With the foregoing arrangement having the female engaging section 125, it is possible to secure and ensure the function for preventing the removal of the plug 11.

Note that, in the described connectors, the plug fixing member is provided on an area in the periphery of the plug area 26; however, each of the described connector may have the plug fixing member on plural areas (for example, two areas, three areas, or more) oppositely in the periphery of the plug area 26.

Further, in the described connectors, the plug fixing member for composing mechanical lock system of the connector is made of a plate-shaped material; however, the plug fixing member may be made of plural kinds of materials. For example, the elastic portion for obtaining rotation stress may be made of a different elastic body. Otherwise, the elasticity required for the plug fixing member may be obtained by a separately provided elastic body. Further, according to the required characteristics, a different component may respectively used for the female engaging section (23, 123, or 125) and the pressed section 24.

Figure 26:
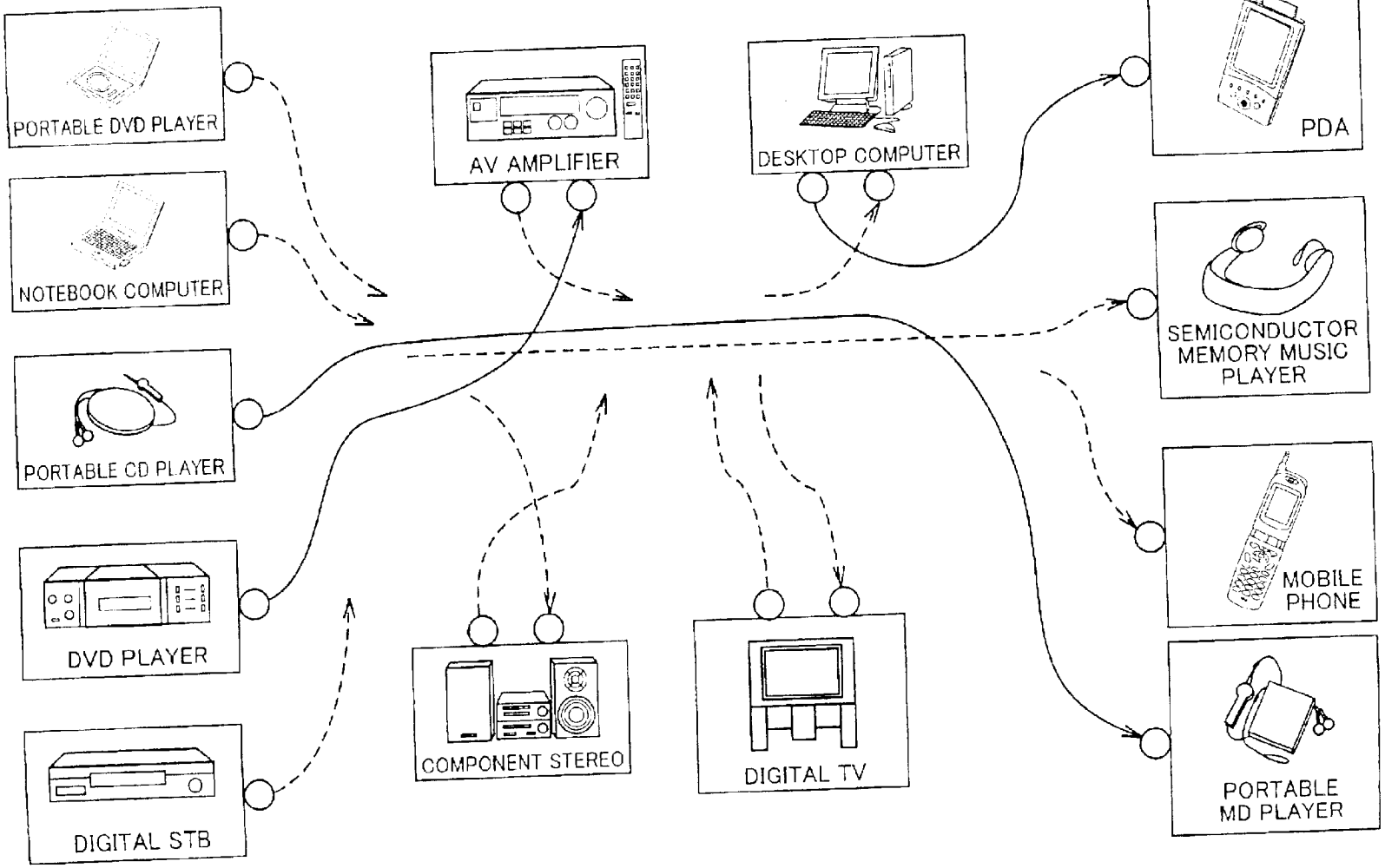
FIG. 26 is an explanatory view showing examples of electric apparatuses having the connector of the present embodiment, and connection examples between the electronic apparatuses.
Figure 27:
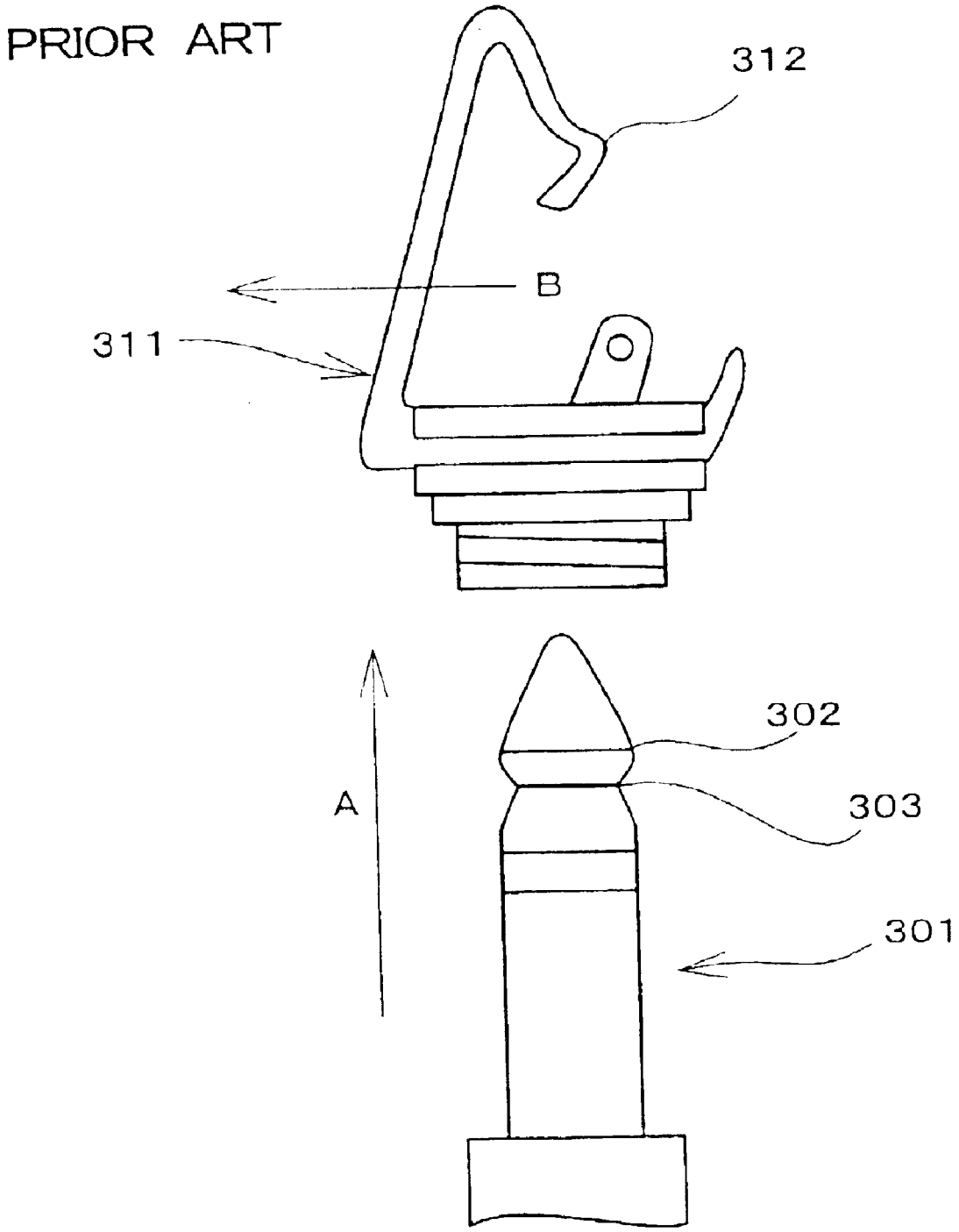
FIG. 27 is a front view showing a conventional jack, and a plug inserted in the jack.
Figure 28:
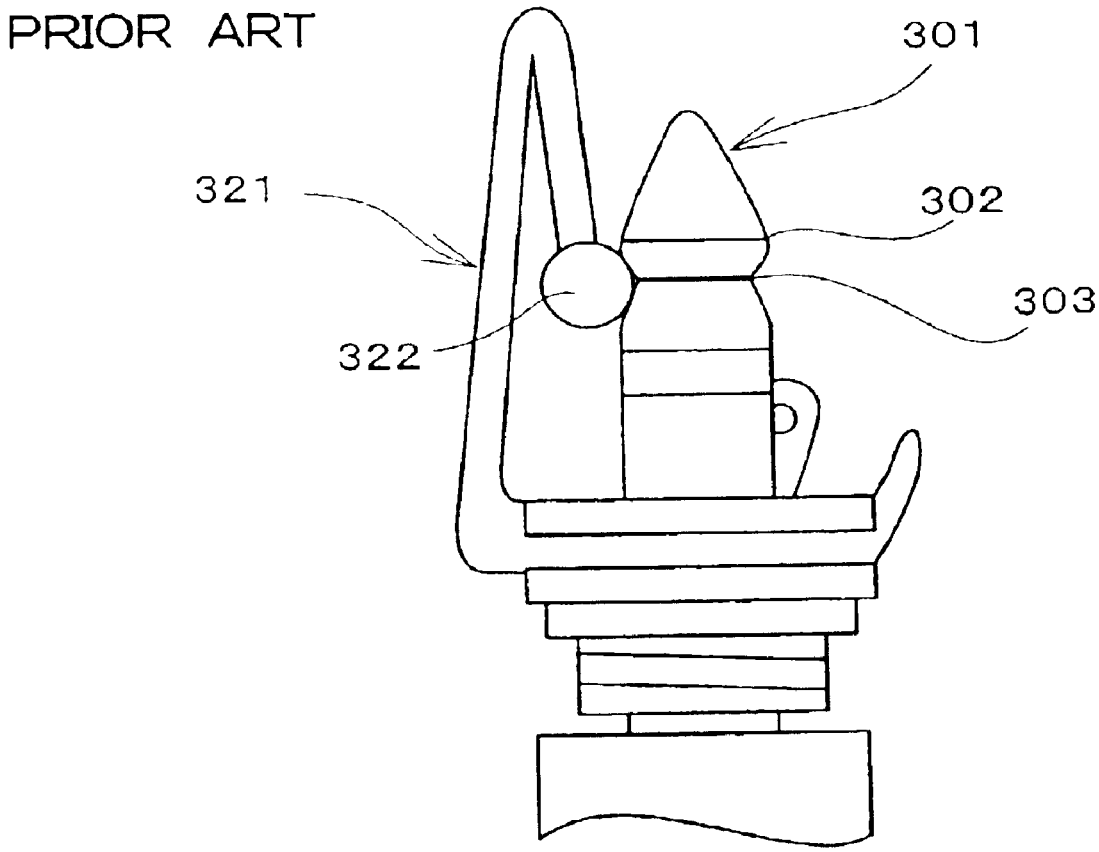
FIG. 28 is a front view showing another conventional jack, and a plug inserted in the jack.
Figure 29:
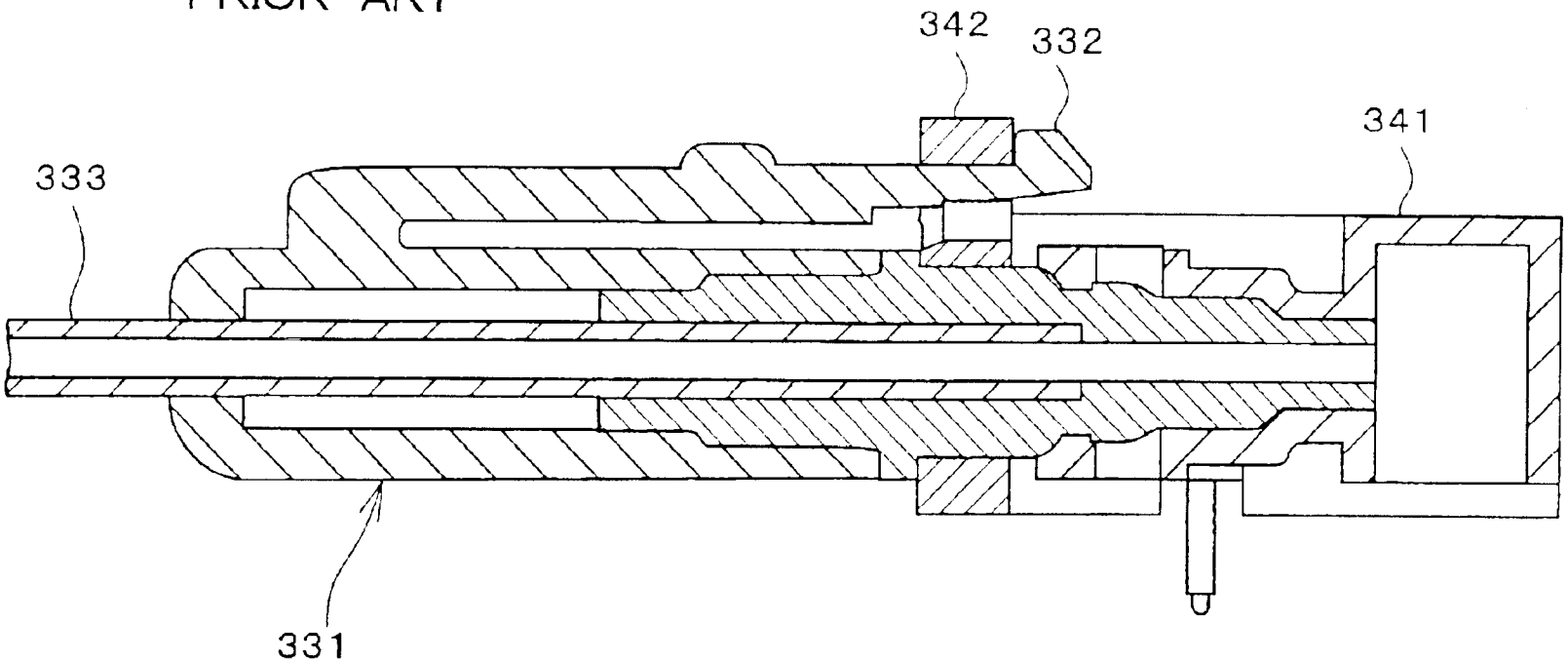
FIG. 29 PRIOR ART
FIG. 29 is a vertical cross-sectional view showing a plug having a claw section for preventing an unwanted removal in an insertion state into a conventional connector corresponding to the plug.

Further, the described connectors may be used for various electronic apparatuses. As shown in FIG. 26, example of the electronic apparatus can be a portable DVD player, a notebook computer (personal computer), a portable CD player, a stationary DVD player, a digital STB, an AV (Audio and Visual) amplifier, a desktop computer, a component stereo player, a digital TV, a PDA (Personal Digital Assistants), a semiconductor memory player, a mobile phone, or a portable MD (Mini Disk) player. These electronic apparatuses are capable of being connected to each other through a provided connector with a connection cable.

Note that, FIG. 26 shows the case where a sending connector and a receiving connector are respectively provided; however, the present invention may also be adopted for a sending/receiving connector which is capable of both sending and receiving by using a single optical fiber, for example.

As described, the connector of the present invention is capable of insertion and removal of a plug having a moving section. The connector includes plug fixing means for fixing the front end section of the plug when the moving section is shifted in a plug insertion direction with the insertion of the plug, and for releasing the front end section of the plug thus fixed when the moving section is shifted in a plug removal direction.

The foregoing connector may be arranged such that the plug fixing means includes a pressed section, which is shifted by being pressed by the moving section, and a female engaging section, which is shifted with the shifting of the pressed section and engaged with the front end section of the plug so as to prevent removal of the plug.

Further, the connector of the present invention is capable of insertion/removal of a plug including the male engaging section formed on the front side of the small diameter section, and the moving section formed on the back side of the small diameter section wherein the male engaging section and the moving section have a portion larger in diameter than the small diameter section, and the moving section is movable with respect to the small diameter section and the male engaging section in insertion/removal direction of the plug into/from the connector. The connector is provided with plug fixing means including a pressed section, which is pressed by the moving section at the insertion of the plug so as to be shifted, and a female engaging section, which is shifted with the shifting of the pressed section and is engaged with the male engaging section so as to prevent removal of the plug.

The foregoing connector may have an arrangement such that the plug fixing means includes an elastic body portion causing rotation of the female engaging section by its recovery force from elastic deformation due to the shifting of the pressed section by being shifted by the moving section.

As described, the connector of the present invention is capable of insertion and removal of a plug having an unmoving section and a moving section that is movable with respect to the unmoving section. The connector includes plug fixing means for fixing the unmoving section when the moving section is shifted in a plug insertion direction with the insertion of the plug, and for releasing the unmoving section thus fixed when the moving section is shifted in a plug removal direction.

The foregoing connector may be arranged such that the unmoving section is provided on a front end of the plug, and the plug fixing means includes a pressed section, which is pressed by the moving section so as to be shifted; and an engaging section (female engaging section), which is shifted with the shifting of the pressed section and is engaged with the unmoving section so as to prevent removal of the plug.

With this arrangement, the pressed section of the plug fixing means is pressed by the moving section of the plug so as to be shifted; and the engaging section is shifted with the shifting of the pressed section and is engaged with the unmoving section on the front end of the plug. Accordingly, the plug can appropriately be fixed and released by the movement of the moving section of the plug.

The foregoing connector may be arranged such that the engaging section is moved in a direction orthogonal to the plug insertion direction and the plug removal direction when the engaging section is engaged or disengaged with/from the unmoving section.

With this arrangement, it is possible to appropriately carry out the engagement and disengagement of the engaging section of the plug fixing means with/from the unmoving section of the plug.

The foregoing connector may be arranged such that the engaging section includes a first surface to be in contact with the unmoving section of the plug and a second surface opposite to the first surface, and an angle of the first surface with respect to the plug insertion direction when the plug is completely inserted is larger than an angle of the second surface with respect to the plug removal direction before the plug is inserted.

In this arrangement, when the plug is completely inserted into the connector, the engaging section is engaged with the unmoving section of the plug by the first surface so as to prevent removal of the plug. In this case, the angle of the first surface with respect to the plug insertion direction when the plug is completely inserted is larger than the angle of the second surface with respect to the plug removal direction before the plug is inserted, thus securely preventing the removal of the plug by the engaging section.

Note that, in the case where the front end section of the plug is comes in contact with the second surface of the engaging section at the insertion of the plug into the connector, the angle of the second surface may be adjusted relatively with respect to the angle of the first surface so that the insertion of the plug can easily be carried out.

The foregoing connector may be arranged such that the plug fixing means is made of a member including the pressed section and the engaging section that are directly or indirectly continuous to each other, and the engaging section is rotated about a supporting section, which is formed on the plug fixing means, so as to be engaged with the unmoving section of the plug.

With this arrangement, the plug fixing means can be made of, for example, a single plate-shaped material, thereby simplifying the structure of the connector.

The foregoing connector may be arranged such that the engaging section is rotated due to a recovery force for recovering a portion of the plug fixing means from elastic deformation, which is caused by the shifting of the pressed section by being pressed by the moving section of the plug.

With this arrangement, the engagement of the engaging section with the unmoving section of the plug can be realized with a simple structure using elasticity of the plug fixing means.

The foregoing connector may be arranged such that the engaging section is rotated due to the shifting of the pressed section by being pressed by the moving section of the plug.

With this arrangement, the engagement of the engaging section with the unmoving section of the plug can be realized with a simple structure using the shifting of the pressed section by being pressed by the moving section of the plug.

The foregoing connector may be arranged such that the engaging section, the pressed section and the supporting section are disposed in this order in the plug removal direction.

With this arrangement, it is possible to easily prepare the plug fixing means using elasticity for carrying out the engagement of the engaging section with the unmoving section of the plug. Further, when the connector has the supporting section fixed in the plug removal direction side, it is possible to reduce density of components of the connector in the plug insertion direction side.

The foregoing connector may be arranged such that the engaging section, the supporting section and the pressed section are disposed in this order in the plug removal direction.

With this arrangement, it is possible to easily prepare the plug fixing means using the shifting of the pressed section by being pressed by the moving section of the plug for carrying out the engagement of the engaging section with the unmoving section of the plug. Further, since the foregoing arrangement has the pressed section on one side of the supporting section and has the engaging section on the other side of the supporting section, by providing the supporting section in the vicinity of the center in the plug insertion/removal direction of the plug area, it is possible to reduce density of components of the connector in the plug insertion direction side and in the plug removal direction side.

The foregoing connector may be arranged such that the pressed section, the engaging section and the supporting section are provided around and on one side of the plug inserted into the connector.

With this arrangement, the components of the connector are gathered in one side of the plug area, the connector can be downsized.

The foregoing connector may be arranged such that the pressed section and the supporting section are provided around and on one side of the plug inserted into the connector, and the engaging section is provided on a side opposite to the side where the pressed section and the supporting section are provided.

With this arrangement, a long distance is ensured between the supporting section and the engaging section in the direction orthogonal to the plug insertion/removal direction, and the elasticity of the long distance area enables the engaging section to be firmly engaged with the unmoving section of the plug. Consequently, the plug is stably fixed in a certain position.

The foregoing connector may include a guide member for guiding the engaging section so that the engaging section is moved in the direction orthogonal to the plug insertion direction and the plug removal direction.

With this arrangement, since the guide member guides the movement of the engaging section, it is possible to stably carry out the engagement operation and the disengagement operation of the engaging section with/from the unmoving section of the plug.

The foregoing connector may be arranged such that at least one portion in an area from the supporting section to the pressed section of the plug fixing means is made of an elastic body, which is elastically deformed with the shifting of the pressed section by being pressed by the moving section of the plug.

With this arrangement, the elastic body can be used for appropriately carrying out the engagement operation and the disengagement operation of the engaging section with/from the unmoving section of the plug, in the arrangement having the engaging section, the pressed section and the supporting section provided in this order in the plug removal direction.

The foregoing connector may be arranged such that the plug fixing means includes an extension section on a portion opposite to the supporting section with respect to the engaging section, and at least one portion of the extension section is made of an elastic body, which is elastically deformed with the shifting of the pressed section by being pressed by the moving section of the plug.

With this arrangement, the elasticity of the extension section can be used for appropriately carrying out the engagement operation and the disengagement operation of the engaging section with/from the unmoving section of the plug, in the arrangement having the engaging section, the pressed section and the supporting section provided in this order in the plug removal direction. Further, this arrangement has less density of the components of the connector in the supporting section side, since the extension section with the elasticity is provided on a side opposite to the supporting section side with respect to the engaging section.

The foregoing connector may be arranged such that the plug fixing means includes at least one portion made of an elastic body, which is elastically deformed with the shifting of the pressed section by being pressed by the moving section of the plug. In this arrangement, the portion of an elastic body is provided on an area from the supporting section to a side opposite to the engaging section with respect to the supporting section.

With this arrangement, the elastic body can be used for appropriately carrying out the engagement operation and the disengagement operation of the engaging section with/from the unmoving section of the plug, in the arrangement having the engaging section, supporting section and the pressed section provided in this order in the plug removal direction.

The foregoing connector may be arranged such that the plug fixing means includes an extension section on a portion opposite to the supporting section with respect to the engaging section, and at least one portion of the extension section is made of an elastic body, which is elastically deformed with the shifting of the pressed section by being pressed by the moving section of the plug.

With this arrangement, the elastic body can be used for appropriately carrying out the engagement operation and the disengagement operation of the engaging section with/from the unmoving section of the plug, in the arrangement having the engaging section, supporting section and the pressed section provided in this order in the plug removal direction.

The foregoing connector may be arranged such that the unmoving section of the plug has a sloped surface on a back end, and the engaging section is engaged with the sloped surface so as to prevent removal of the plug, and the supporting section is provided on a center of a circle in contact with the sloped surface, or is provided on an area closer to an axis center side of the plug than the center of the circle.

With this arrangement, it is possible to smoothly carry out the engagement operation and the disengagement operation of the engaging section with/from the unmoving section of the plug.

The foregoing connector may be arranged such that the plug fixing means is made of a plate-shaped material thereon having the engaging section, the presses section and the supporting section, and an end portion of the plug fixing means opposite to the engaging section with respect to the supporting section is folded and fixed at the supporting section.

With this arrangement, in the foregoing arrangement having the engaging section, the pressed section and the supporting section provided in this order in the plug removal direction, it is possible to easily and securely obtain the elasticity used for appropriately carrying out the engagement operation and the disengagement operation of the engaging section with/from the unmoving section of the plug, in the vicinity of the supporting section.

The foregoing connector may be arranged such that at least one portion in an area from the engaging section to the supporting section of the plug fixing means is made of an elastic body, and when a force at or above a certain level is exerted in the plug removal direction with respect to the unmoving section of the plug in an engagement state with the engaging section, the elastic body is deformed so as to disengage the engaging section from the unmoving section.

With this arrangement, when a great force is exerted on the plug inserted into the connector, such as a case where one's foot stumbles on the connection cable having the plug, it is possible to prevent breakage of the plug and/or the connector, and also, to prevent falling and breakage of the electronic apparatus to which the connection cable is connected.

The foregoing connector may be arranged such that at least the engaging section is made of an elastic plate-shaped material and is formed on an end of the plug fixing means, and when a force at or above a certain level is exerted in the plug removal direction with respect to the unmoving section of the plug in an engagement state with the engaging section, the engaging section is folded so as to be disengaged from the unmoving section.

With this arrangement, when a great force is exerted on the plug inserted into the connector, such as a case where one's foot stumbles on the connection cable having the plug, it is possible to prevent breakage of the plug and/or the connector, and also, to prevent falling and breakage of the electronic apparatus to which the connection cable is connected.

Further, when the plug is removed from the connector without moving the moving section, the engaging section is folded so that the other portion (the portion other than the engaging section) is protected from a great load.

The foregoing connector may be arranged such that the connector further includes:

an intermediate extension section provided between the engaging section and the pressed section while being connected to at least the engaging section wherein: the intermediate extension section has a plug through hole opened on a side of the engaging section so as to allow the unmoving section to pass through, and a width of the intermediate extension section excluding the plug through hole in a vicinity of a portion connecting to the engaging section is set to be narrower than a width of other portions of the intermediate extension section excluding the plug through hole.

With this arrangement, the essential width of the intermediate extension section excluding the plug through hole in the vicinity of a portion connecting to the engaging section is set to be narrow. This arrangement allows the engaging section to be more easily folded in the portion. Further, by adjusting the width of the intermediate extension section excluding the plug through hole, it is possible to adjust removal easiness of the plug.

The foregoing connector may be adopted for various electronic apparatuses.

Further, all of the described connector can be used as an electric jack for accepting an electric plug, or an optical receptacle for accepting an optical plug.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A connector capable of insertion and removal of a plug having an unmoving section and a moving section that is movable with respect to the unmoving section, comprising:

a plug fixing member for fixing the unmoving section by movement of the moving section and the unmoving section in a plug insertion direction along with insertion of the plug into the connector, and for releasing the unmoving section by shifting of the moving section with respect to the unmoving section in a plug removal direction, wherein:

the unmoving section is provided on a front end of the plug, and the plug fixing member includes:

a pressed section, which is pressed by the moving section of the plug so as to be shifted; and an engaging section, which is shifted with the shifting of the pressed section and is engaged with the unmoving section of the plug so as to prevent removal of the plug, wherein the plug fixing member is made of a member including the pressed section and the engaging section that are directly or indirectly continuous to each other, and the engaging section is rotated about a predetermined supporting section, which is formed on the plug fixing member, so as to be engaged with the unmoving section of the plug, wherein the engaging section is rotated due to a recovery force for recovering a portion of the plug fixing member from elastic deformation, which is caused by the shifting of the pressed section by being pressed by the moving section of the plug, and wherein the engaging section, the pressed section and the predetermined supporting section are disposed in this order in the plug removal direction.

2. A connector capable of insertion and removal of a plug having an unmoving section and a moving section that is movable with respect to the unmoving section, comprising:

a plug fixing member for fixing the unmoving section by movement of the moving section and the unmoving section in a plug insertion direction along with insertion of the plug into the connector, and for releasing the unmoving section by shifting of the moving section with respect to the unmoving section in a plug removal direction wherein:

the unmoving section is provided on a front end of the plug, and the plug fixing member includes:

a pressed section, which is pressed by the moving section of the plug so as to be shifted; and an engaging section, which is shifted with the shifting of the pressed section and is engaged with the unmoving section of the plug so as to prevent removal of the plug, wherein the plug fixing member is made of a member including the pressed section and the engaging section that are directly or indirectly continuous to each other, and the engaging section is rotated about a predetermined supporting section, which is formed on the plug fixing member, so as to be engaged with the unmoving section of the plug, wherein the engaging section is rotated due to the shifting of the pressed section by being pressed by the moving section of the plug, and wherein the engaging section, the predetermined supporting section and the pressed section are disposed in this order in the plug removal direction.

3. A connector capable of insertion and removal of a plug having an unmoving section and a moving section that is movable with respect to the unmoving section, comprising:

a plug fixing member for fixing the unmoving section by movement of the moving section and the unmoving section in a plug insertion direction along with insertion of the plug into the connector, and for releasing the unmoving section by shifting of the moving section with respect to the unmoving section in a plug removal direction, wherein the unmoving section is provided on a front end of the plug, and the plug fixing member includes:

a pressed section, which is pressed by the moving section of the plug so as to be shifted; and an engaging section, which is shifted with the shifting of the pressed section and is engaged with the unmoving section of the plug so as to prevent removal of the plug, wherein the plug fixing member is made of a member including the pressed section and the engaging section that are directly or indirectly continuous to each other, and the engaging section is rotated about a predetermined supporting section, which is formed on the plug fixing member, so as to be engaged with the unmoving section of the plug, wherein the pressed section and the predetermined supporting section are provided around and on one side of the plug inserted into the connector, and the engaging section is provided on a side opposite to the side where the pressed section and the predetermined supporting section are provided.

4. A connector capable of insertion and removal of a plug having an unmoving section and a moving section that is movable with respect to the unmoving section, comprising:

a plug fixing member for fixing the unmoving section by movement of the moving section and the unmoving section in a plug insertion direction along with insertion of the plug into the connector, and for releasing the unmoving section by shifting of the moving section with respect to the unmoving section in a plug removal direction, further comprising:

a guide member for guiding the engaging section that the engaging section is moved in the direction orthogonal to the plug insertion direction and the plug removal direction, wherein the unmoving section is provided on a front end of the plug, and the plug fixing member includes:

a pressed section, which is pressed by the moving section of the plug so as to be shifted; and an engaging section, which is shifted with the shifting of the pressed section and is engaged with the unmoving section of the plug so as to prevent removal of the plug, and wherein the plug fixing member is made of a member including the pressed section and the engaging section that are directly or indirectly continuous to each other, and the engaging section is rotated about a predetermined supporting section, which is formed on the plug fixing member, so as to be engaged with the unmoving section of the plug.

5. A connector capable of insertion and removal of a plug having an unmoving section and a moving section that is movable with respect to the unmoving section, comprising:

a plug fixing member for fixing the unmoving section by movement of the moving section and the unmoving section in a plug insertion direction along with insertion of the plug into the connector, and for releasing the unmoving section by shifting of the moving section with respect to the unmoving section in a plug removal direction, wherein:

the unmoving section is provided on a front end of the plug, and the plug fixing member includes:

a pressed section, which is pressed by the moving section of the plug so as to be shifted; and an engaging section, which is shifted with the shifting of the pressed section and is engaged with the unmoving section of the plug so as to prevent removal of the plug, wherein:

the plug fixing member is made of a member including the pressed section and the engaging section that are directly or indirectly continuous to each other, and the engaging section is rotated about a predetermined supporting section, which is formed on the plug fixing member, so as to be engaged with the unmoving section of the plug, wherein:

the engaging section is rotated due to a recovery force for recovering a portion of the plug fixing member from elastic deformation, which is caused by the shifting of the pressed section by being pressed by the moving section of the plug, wherein the engaging section, the pressed section and the predetermined supporting section are disposed in this order in the plug removal direction, and wherein at least one portion in an area from the predetermined supporting section to the pressed section of the plug fixing member is made of an elastic body, which is elastically deformed with the shifting of the pressed section by being pressed by the moving section of the plug.

6. A connector capable of insertion and removal of a plug having an unmoving section and a moving section that is movable with respect to the unmoving section, comprising:

a plug fixing member for fixing the unmoving section by movement of the moving section and the unmoving section in a plug insertion direction along with insertion of the plug into the connector, and for releasing the unmoving section by shifting of the moving section with respect to the unmoving section in a plug removal direction, wherein:

the unmoving section is provided on a front end of the plug, and the plug fixing member includes:

a pressed section, which is pressed by the moving section of the plug so as to be shifted; and an engaging section, which is shifted with the shifting of the pressed section and is engaged with the unmoving section of the plug so as to prevent removal of the plug, wherein:

the plug fixing member is made of a member including the pressed section and the engaging section that are directly or indirectly continuous to each other, and the engaging section is rotated about a predetermined supporting section, which is formed on the plug fixing member, so as to be engaged with the unmoving section of the plug, wherein the engaging section is rotated due to a recovery force for recovering a portion of the plug fixing member from elastic deformation, which is caused by the shifting of the pressed section by being pressed by the moving section of the plug, wherein the engaging section, the pressed section and the predetermined supporting section are disposed in this order in the plug removal direction, and wherein the plug fixing member includes an extension section on a portion opposite to the predetermined supporting section with respect to the engaging section, and at least one portion of the extension section is made of an elastic body, which is elastically deformed with the shifting of the pressed section by being pressed by the moving section of the plug.

7. A connector capable of insertion and removal of a plug having an unmoving section and a moving section that is movable with respect to the unmoving section, comprising:

a plug fixing member for fixing the unmoving section by movement of the moving section and the unmoving section in a plug insertion direction along with insertion of the plug into the connector, and for releasing the unmoving section by shifting of the moving section with respect to the unmoving section in a plug removal direction, wherein:

the unmoving section is provided on a front end of the plug, and the plug fixing member includes:

a pressed section, which is pressed by the moving section of the plug so as to be shifted; and an engaging section, which is shifted with the shifting of the pressed section and is engaged with the unmoving section of the plug so as to prevent removal of the plug, wherein the plug fixing member is made of a member including the pressed section and the engaging section that are directly or indirectly continuous to each other, and the engaging section is rotated about a predetermined supporting section, which is formed on the plug fixing member, so as to be engaged with the unmoving section of the plug, wherein the engaging section is rotated due to the shifting of the pressed section by being pressed by the moving section of the plug, wherein the engaging section, the predetermined supporting section and the pressed section are disposed in this order in the plug removal direction, and wherein the plug fixing member includes at least one portion made of an elastic body, which is elastically deformed with the shifting of the pressed section by being pressed by the moving section of the plug, the portion being provided on an area from the predetermined supporting section to a side opposite to the engaging section with respect to the supporting section.

8. A connector capable of insertion and removal of a plug having an unmoving section and a moving section that is movable with respect to the unmoving section, comprising:

a plug fixing member for fixing the unmoving section by movement of the moving section and the unmoving section in a plug insertion direction along with insertion of the plug into the connector, and for releasing the unmoving section by shifting of the moving section with respect to the unmoving section in a plug removal direction, wherein:

the unmoving section is provided on a front end of the plug, and the plug fixing member includes:

a pressed section, which is pressed by the moving section of the plug so as to be shifted; and an engaging section, which is shifted with the shifting of the pressed section and is engaged with the unmoving section of the plug so as to prevent removal of the plug, wherein the plug fixing member is made of a member including the pressed section and the engaging section that are directly or indirectly continuous to each other, and the engaging section is rotated about a predetermined supporting section, which is formed on the plug fixing member, so as to be engaged with the unmoving section of the plug, wherein the engaging section is rotated due to the shifting of the pressed section by being pressed by the moving section of the plug, wherein the engaging section, the predetermined supporting section and the pressed section are disposed in this order in the plug removal direction, and wherein the plug fixing member includes an extension section on a portion opposite to the predetermined supporting section with respect to the engaging section, and at least one portion of the extension section is made of an elastic body, which is elastically deformed with the shifting of the pressed section by being pressed by the moving section of the plug.

9. A connector capable of insertion and removal of a plug having an unmoving section and a moving section that is movable with respect to the unmoving section, comprising:

a plug fixing member for fixing the unmoving section by movement of the moving section and the unmoving section in a plug insertion direction along with insertion of the plug into the connector, and for releasing the unmoving section by shifting of the moving section with respect to the unmoving section in a plug removal direction, wherein the unmoving section is provided on a front end of the plug, and the plug fixing member includes:

a pressed section, which is pressed by the moving section of the plug so as to be shifted; and an engaging section, which is shifted with the shifting of the pressed section and is engaged with the unmoving section of the plug so as to prevent removal of the plug, wherein the plug fixing member is made of a member including the pressed section and the engaging section that are directly or indirectly continuous to each other, and the engaging section is rotated about a predetermined supporting section, which is formed on the plug fixing member, so as to be engaged with the unmoving section of the plug, and wherein the unmoving section of the plug has a sloped surface on a back end, and the engaging section is engaged with the sloped surface so as to prevent removal of the plug, and the predetermined supporting section is provided on a center of a circle in contact with the sloped surface, or is provided on an area closer to an axis center side of the plug than the center of the circle.

10. A connector capable of insertion and removal of a plug having an unmoving section and a moving section that is movable with respect to the unmoving section, comprising:

a plug fixing member for fixing the unmoving section by movement of the moving section and the unmoving section in a plug insertion direction along with insertion of the plug into the connector, and for releasing the unmoving section by shifting of the moving section with respect to the unmoving section in a plug removal direction, wherein:

the unmoving section is provided on a front end of the plug, and the plug fixing member includes:

a pressed section, which is pressed by the moving section of the plug so as to be shifted; and an engaging section, which is shifted with the shifting of the pressed section and is engaged with the unmoving section of the plug so as to prevent removal of the plug, wherein:

the plug fixing member is made of a member including the pressed section and the engaging section that are directly or indirectly continuous to each other, and the engaging section is rotated about a predetermined supporting section, which is formed on the plug fixing member, so as to be engaged with the unmoving section of the plug, wherein:

the engaging section is rotated due to a recovery force for recovering a portion of the plug fixing member from elastic deformation, which is caused by the shifting of the pressed section by being pressed by the moving section of the plug, wherein the engaging section, the pressed section and the predetermined supporting section are disposed in this order in the plug removal direction, and wherein the plug fixing member is made of a plate-shaped material having the engaging section, the pressed section and the predetermined supporting section, and an end portion of the plug fixing member opposite to the engaging section with respect to the predetermined supporting section is folded and fixed at the predetermined supporting section.

11. A connector capable of insertion and removal of a plug having an unmoving section and a moving section that is movable with respect to the unmoving section, comprising:

a plug fixing member for fixing the unmoving section by movement of the moving section and the unmoving section in a plug insertion direction along with insertion of the plug into the connector, and for releasing the unmoving section by shifting of the moving section with respect to the unmoving section in a plug removal direction, wherein the unmoving section is provided on a front end of the plug, and the plug fixing member includes:

a pressed section, which is pressed by the moving section of the plug so as to be shifted; and an engaging section, which is shifted with the shifting of the pressed section and is engaged with the unmoving section of the plug so as to prevent removal of the plug, wherein the plug fixing member is made of a member including the pressed section and the engaging section that are directly or indirectly continuous to each other, and the engaging section is rotated about a predetermined supporting section, which is formed on the plug fixing member, so as to be engaged with the unmoving section of the plug, wherein the pressed section and the predetermined supporting section are provided around and on one side of the plug inserted into the connector, and the engaging section is provided on a side opposite to the side where the pressed section and the predetermined supporting section are provided, and wherein at least the engaging section is made of an elastic plate-shaped material and is formed on an end of the plug fixing member, and when a force at or above a certain level is exerted in the plug removal direction with respect to the unmoving section of the plug in an engagement state with the engaging section, the engaging section is folded so as to be disengaged from the unmoving section.

12. A connector capable of insertion and removal of a plug having an unmoving section and a moving section that is movable with respect to the unmoving section, comprising:

a plug fixing member for fixing the unmoving section by movement of the moving section and the unmoving section in a plug insertion direction along with insertion of the plug into the connector, and for releasing the unmoving section by shifting of the moving section with respect to the unmoving section in a plug removal direction, wherein the unmoving section is provided on a front end of the plug, and the plug fixing member includes:

a pressed section, which is pressed by the moving section of the plug so as to be shifted; and an engaging section, which is shifted with the shifting of the pressed section and is engaged with the unmoving section of the plug so as to prevent removal of the plug, wherein the plug fixing member is made of a member including the pressed section and the engaging section that are directly or indirectly continuous to each other, and the engaging section is rotated about a predetermined supporting section, which is formed on the plug fixing member, so as to be engaged with the unmoving section of the plug, wherein the pressed section and the predetermined supporting section are provided around and on one side of the plug inserted into the connector, and the engaging section is provided on a side opposite to the side where the pressed section and the predetermined supporting section are provided, and further comprising:

an intermediate extension section provided between the engaging section and the pressed section while being connected to at least the engaging section; wherein:

the intermediate extension section has a plug through hole opened on a side of the engaging section so as to allow the unmoving section to pass through, and a width of the intermediate extension section excluding the plug through hole in a vicinity of a portion connecting to the engaging section is set to be narrower than a width of other portions of the intermediate extension section excluding the plug through hole.

* * * * *